US008186926B2

(12) United States Patent
Littlely

(10) Patent No.: US 8,186,926 B2
(45) Date of Patent: May 29, 2012

(54) DRILL ROD HANDLER

(75) Inventor: Keith W. Littlely, Balcatta (AU)

(73) Assignee: Longyear TM, Inc., South Jordan, UT (US)

( * ) Notice: Subject to any disclaimer, the term of this patent is extended or adjusted under 35 U.S.C. 154(b) by 418 days.

(21) Appl. No.: 12/477,788

(22) Filed: Jun. 3, 2009

(65) Prior Publication Data

US 2009/0238663 A1 Sep. 24, 2009

Related U.S. Application Data

(63) Continuation-in-part of application No. 12/297,038, filed as application No. PCT/AU2007/000476 on Apr. 11, 2007.

(30) Foreign Application Priority Data

Apr. 11, 2006 (AU) ..... 2006901901
Jul. 20, 2006 (AU) ..... 2006903908

(51) Int. Cl.

| | |
|---|---|
| ***G01C 9/00*** | (2006.01) |
| ***G01C 9/12*** | (2006.01) |
| ***G01C 9/06*** | (2006.01) |
| ***E21B 15/00*** | (2006.01) |
| ***E21B 15/04*** | (2006.01) |
| ***E21B 19/00*** | (2006.01) |
| ***E21B 19/15*** | (2006.01) |

(52) U.S. Cl. ..... 414/22.55; 414/730; 414/745.5; 33/366.24; 73/514.32

(58) Field of Classification Search ..... 166/77.51, 166/77.52; 175/85; 33/366.24, 391, 396, 33/399; 414/22.51, 22.53–22.56, 22.58, 414/22.62, 22.65, 22.69, 22.71, 23, 730, 414/736, 745.1, 745.3, 745.4, 745.5, 745.8, 414/746.3, 746.5, 908, 911; 700/247, 251, 700/253; 73/510, 514.32, 514.37; 910/30, 910/39, 46

See application file for complete search history.

(56) References Cited

U.S. PATENT DOCUMENTS

| | | | | |
|---|---|---|---|---|
| 3,438,266 | A * | 4/1969 | Carow et al. | 73/514.12 |
| 3,920,972 | A * | 11/1975 | Corwin et al. | 700/251 |
| 4,042,123 | A | 8/1977 | Sheldon et al. | |
| 4,077,132 | A * | 3/1978 | Erickson | 33/366.24 |
| 4,113,033 | A * | 9/1978 | Lindblad | 173/1 |
| 4,547,109 | A * | 10/1985 | Young et al. | 414/22.53 |

(Continued)

FOREIGN PATENT DOCUMENTS

| | | |
|---|---|---|
| CA | 2648824 | 9/2009 |
| WO | 98/55728 | 12/1998 |
| WO | 99/31346 | 6/1999 |
| WO | 00/65193 | 11/2000 |
| WO | 2007115375 A1 | 10/2007 |

OTHER PUBLICATIONS

U.S. Appl. No. 12/297,038, filed Sep. 24, 2009, Keith Littely.
International Search Report and Written Opinion dated Jan. 17, 2011 from PCT Application No. PCT/US2010/037069 filed Jun. 2, 2010 (6 pages).
Office Action dated Oct. 25, 2010 from Canadian Application No. 2,648,824 filed Oct. 13, 2008 (2 pages).
Office Action dated Jun. 15, 2010 from Australian Application No. 2007236557 filed Apr. 11, 2007 (2 pages).

(Continued)

*Primary Examiner* — Gregory Adams
(74) *Attorney, Agent, or Firm* — Ballard Spahr LLP

(57) ABSTRACT

According to one example of the invention, a drill rod handler includes a movable clamp. A position sensor system for the drill rod handler includes a level sensor that is configured to detect a position of the moveable clamp with respect to gravity. The position sensor system further includes a rotation sensor configured to detect a rotational position of the moveable clamp with respect to a defined axis that runs parallel to gravity. Furthermore, the position sensor system includes a control center that is communicably connected to the level sensor and the rotation sensor.

19 Claims, 19 Drawing Sheets

U.S. PATENT DOCUMENTS

| | | | | | |
|---|---|---|---|---|---|
| 4,601,000 | A | * | 7/1986 | Montabert | 173/11 |
| 4,606,133 | A | * | 8/1986 | Mills | 33/366.14 |
| 4,718,805 | A | | 1/1988 | Becker | |
| 4,875,823 | A | * | 10/1989 | Fuse et al. | 414/735 |
| 5,115,690 | A | * | 5/1992 | Torii et al. | 74/490.02 |
| 5,423,390 | A | * | 6/1995 | Donnally et al. | 175/85 |
| 5,458,454 | A | * | 10/1995 | Sorokan | 414/800 |
| 5,788,401 | A | | 8/1998 | Drenth | |
| 5,789,890 | A | * | 8/1998 | Genov et al. | 318/567 |
| 5,821,419 | A | | 10/1998 | Mader et al. | |
| 5,941,324 | A | | 8/1999 | Bennett | |
| 6,109,620 | A | | 8/2000 | Roberts et al. | |
| 6,196,598 | B1 | | 3/2001 | Yao | |
| 6,298,927 | B1 | | 10/2001 | Back | |
| 6,634,443 | B1 | * | 10/2003 | Paech et al. | 175/85 |
| 6,845,564 | B2 | * | 1/2005 | Saigh et al. | 33/366.24 |
| 7,318,283 | B2 | * | 1/2008 | Kurose et al. | 33/366.24 |
| 2006/0248960 | A1 | * | 11/2006 | Liskow et al. | 73/856 |
| 2009/0238663 | A1 | * | 9/2009 | Littlely | 414/22.54 |

OTHER PUBLICATIONS

International Search Report and Written Opinion dated May 17, 2007 from PCT Application No. PCT/AU2007/000476 (7 pages).

Office Action dated Dec. 9, 2011 from U.S. Appl. No. 12/297,038, filed Sep. 24, 2009 (5 pages).

Office Action dated Jan. 23, 2012 from U.S. Appl. No. 12/297,038, filed Sep. 24, 2009 (8 pages).

* cited by examiner

DRILL ROD HANDLER

CROSS-REFERENCE TO RELATED APPLICATIONS

This application is a continuation-in-part of U.S. application Ser. No. 12/297,038 which is a national stage entry of PCT Application No. PCT/AU2007/000476 filed Apr. 11, 2007; which claims priority to Australian application number 2006901901 filed Apr. 11, 2006 and to Australian application number 2006903908 filed Jul. 20, 2006. The aforementioned U.S. and PCT applications are incorporated herein by reference in their entirety.

BACKGROUND OF THE INVENTION

1. The Field of the Invention

The present invention relates to a handling means for elongate items such as lengths of drill rods, poles, solid pipes, thin wall pipe, and the like.

Throughout the specification, the term "drill rod" will be taken to include all forms of elongate members used in the drilling, installation and maintenance of bore holes and wells in the ground and will include rods, pipes, tubes and casings which are provided in lengths and are interconnected to be used in the borehole.

2. Relevant Technology

One particular application of the invention relates to an accessory which can be used with drill rigs which are to be used in drilling bore holes. Such drill rigs generally comprise an upstanding mast which has a drill head mounted to it where the drill head is capable of movement along the mast and the drill head is provided with means which can receive and engage the upper end of a drill string and can apply a rotational force to the drill string to cause it to rotate within the bore hole whereby such rotation results in the cutting action by the drill bit mounted to the lower end of the drill string. The drill string includes a number of drill rods that are connected end to end. Each drill rod generally is at the most equal to the height of the mast. Frequently, each drill rod can have a length up to approximately six meters. During a drilling operation, when the drill head has reached the lower end of the mast, the drill string is clamped and the drill head is disconnected from the drill string. A fresh length of drill rod is then raised into position in order that the upper end of the fresh length is engaged to the drill head and the lower end of the fresh length is engaged with the upper end of the drill string. Once the fresh length of drill rod has been installed, the drilling operation can recommence until the drill head again reaches the lower end of the mast. During drilling activities of deep bore holes which may extend for hundreds of meters, it is necessary to locate fresh lengths of drill rod into a drill string at very regular intervals.

Often the drill rig is mounted to the chassis of a motorized vehicle such as a truck or lorry. The drill rods may be mounted in a storage zone such that they lie horizontally in a stacked array beside the drilling mast on the same vehicle. Alternatively, the drill rods may be mounted on a vehicle parked alongside the drilling rig or stacked on the ground beside the drilling rig.

One common method for raising a drill rod to the mast comprises mounting holder along the drill rod, connecting that holder to a cable carried by a winch located at the upper end of the mast, and then lifting the drill rod into position. This requires manipulation by a member of the drill rig crew who is required to support and guide the lowermost end of the length of drill rod as the length of drill rod is being raised into position. Due to the nature of drilling sites, this action can be quite hazardous. In addition, during the raising of the drill rod, it has been known for the upper portion of the drill rod to strike some obstruction on the drill mast which causes the lower end to move in an unpredictable manner, possibly resulting in injury to the crew member. In addition, this process requires joint coordination between the crew member guiding the one end and the other crew member controlling the winch.

Similarly during the raising of a drill string, it becomes necessary to regularly remove drill rods from a drill string and locate those drill rods in the storage zone located beside the mast which may either be located on the same vehicle as the drilling rig, on some adjacent vehicle, or on the ground beside the drilling rig. This can also create hazards for the personnel required to handle and store the drill rods.

In the past, alternative arrangements have been proposed for the handling of drill rods. Examples of such are described in AU693382 and U.S. Pat. No. 6,298,927. Throughout this specification, the discussion of the background and prior art to the invention is intended only to facilitate an understanding of the present invention. It should be appreciated that the discussion is not an acknowledgement or admission that any of the material referred to was part of the common general knowledge in Australia or the world as was at the priority date of the application.

BRIEF SUMMARY OF THE INVENTION

According to one example, a drill rod handler includes a movable engaging means configured to engage a drill rod and move the drill rod between a first position and a second position. The drill rod handler further includes one or more position sensors configured to detect the first position and the second position. The one or more position sensors are communicably connected to a control center. The control center permits or restricts the moveable engaging means from engaging or disengaging the drill rod based on the position of the moveable engaging means.

According to another example, a position sensor for a drill rod handler includes a housing with a pendulum rotatably connected to the housing. The pendulum includes a trigger. The position sensor further includes a proximity switch configured to detect the trigger at a specified position with respect to gravity.

According to another example embodiment of the invention, a drill rod handler includes a movable clamp. A position sensor system for the drill rod handler includes a level sensor that is configured to detect a level position of the moveable clamp with respect to gravity. The position sensor system further includes a rotation sensor configured to detect a rotational position of the moveable clamp with respect to a defined axis that runs parallel to gravity and/or aligned with mast. Furthermore, the position sensor system includes a control center that is communicably connected to the level sensor and the rotation sensor.

Another example of the invention includes a method of handling drill rods with a controllable clamp. The method includes engaging the drill rod with the controllable clamp at a first position. Upon engaging the drill rod, the method further includes locking the controllable clamp and transporting the drill rod from the first position to a second position. Moreover, the method includes the act of unlocking the controllable clamp and disengaging the drill rod at the second position.

These and other objects and features of the present invention will become more fully apparent from the following description and appended claims, or may be learned by the practice of the invention as set forth hereinafter.

BRIEF DESCRIPTION OF THE DRAWINGS

To further clarify the above and other advantages and features of the present invention, a more particular description of the invention will be rendered by reference to specific embodiments thereof which are illustrated in the appended drawings. It is appreciated that these drawings depict only illustrated embodiments of the invention and are therefore not to be considered limiting of its scope. The invention will be described and explained with additional specificity and detail through the use of the accompanying drawings in which.

DETAILED DESCRIPTION

Figure 1:
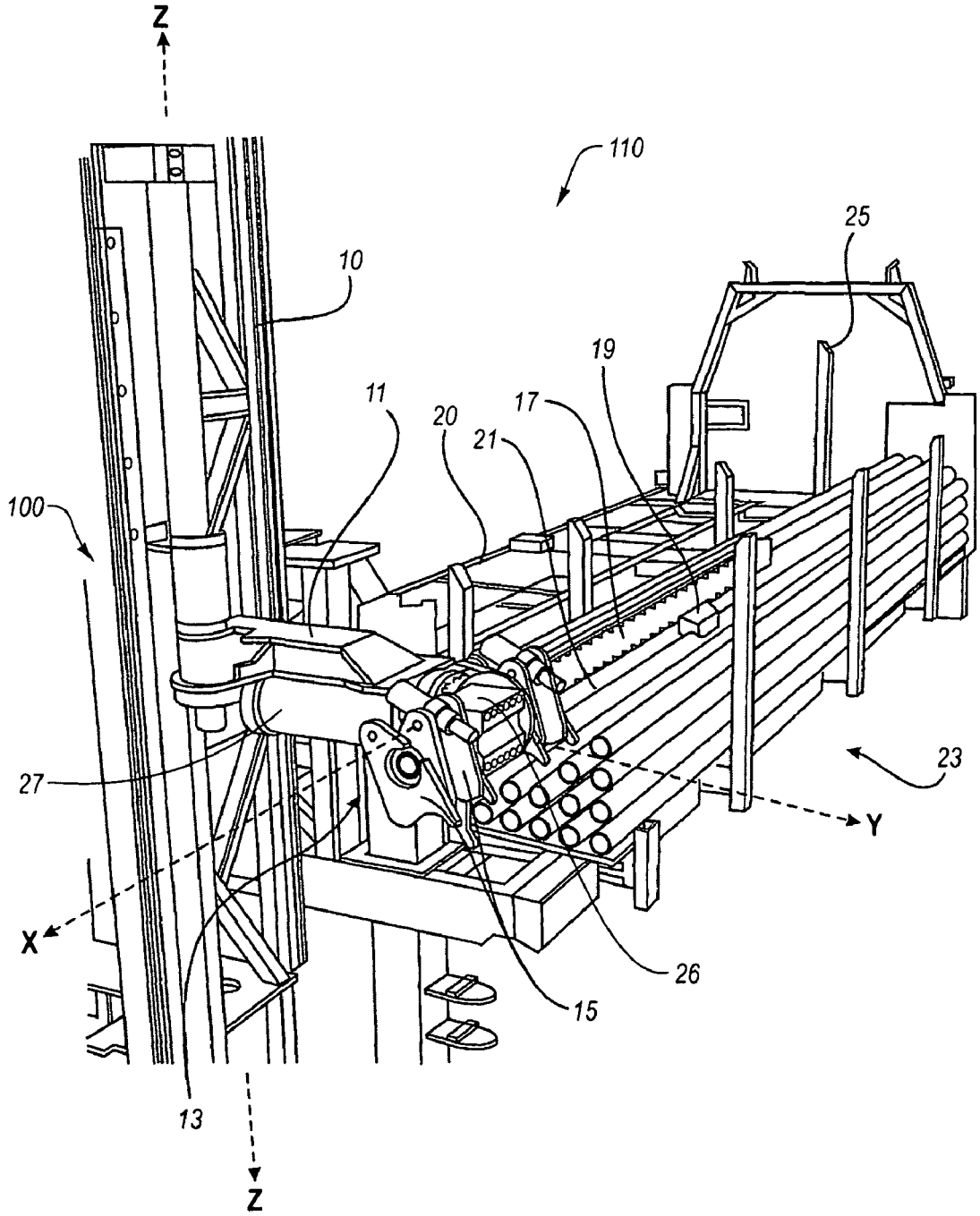
FIG. 1 is an isometric view of a drill rod handler according to the first embodiment associated with a drilling mast at the point in time when a drill rod has been initially engaged by the engaging member.

A drill rod handling means is provided that can be incorporated into a drill rig either as an attachment or as an integral part of the drill rig. Such drill rigs generally comprise an upstanding mast that extends upwardly from a slips table. The mast may include a drive head that is movable along the mast between a lower position adjacent the slips table and a raised position towards the free end of the mast. The mast is pivotable on its mounting about a transverse axis which is substantially contained within the plane of the slips table. The pivotal movement of the mast is controlled and enables the mast to adopt a variety of erect positions which can include the horizontal or vertical position to enable a bore hole to be drilled at any desired angle.

In at least one example, the drilling rig can be mounted to a vehicle (not shown). In other examples, the drilling rig can be transported by a vehicle and then left in a stationary position when de-coupled from the vehicle. In yet other examples, the drill rig can be configured to be portable by itself, for example, in the same manner as a Mini Sonic® drilling rig.

The drill head is provided with means which can receive and engage the upper end of a drill string (not shown) and can apply a rotational force to the drill string to cause it to rotate within the bore hole whereby such rotation results in the cutting action by the drill bit mounted to the lower end of the drill string. In addition, the drill head may have means for applying an axial force to the drill string and is associated with a compressed air source to provide compressed air to the drill bit to facilitate penetration clearance of cuttings from the bore hole and the operation of fluid operated hammers that may be associated with the drill bit or string. As well, in some instances, the drill head can optionally apply vibrational energy for sonic drilling processes as known in the art.

The drill string may include a plurality of drill rods that are connected end to end and where the length of any individual drill rod is generally, at the most, equal to the height of the mast (e.g. approximately six meters). During a drilling operation when the drill head has reached the lower end of the mast, the drill string is retained to the mast and the drive head is disconnected from the drill string to be raised to the upper end of the mast. A fresh drill rod is then raised into position in order that the upper end of the next drill rod is engaged to the drill head and the lower end of the drill rod is free. The drill head then moves the next drill rod downward to engage the upper end of the drill string. Once the next drill rod has been installed, the drilling operation can recommence until the drill head again reaches the lower end of the mast.

During drilling activities of deep bore holes which may extend for hundreds of meters, it is necessary to locate fresh lengths of drill rod into a drill string at regular intervals. It is usual that the drill rig is provided with a storage zone 23 which can accommodate the drill rods which are to be used such that they lie horizontally in a stacked array beside the drilling mast on the same vehicle, or alternatively on a vehicle parked alongside the drilling rig, or on the ground beside the drilling rig.

In the past, the usual method for raising a fresh drill rod from the storage bin to the mast comprises mounting a holder to an intermediate position along the length of the drill rod connecting that holder to a cable carried by a winch located at the upper end of the mast and then lifting the drill rod into position. This requires extensive manual intervention by a member of the drill rig crew who is required to support and guide the lowermost end of the drill rod as the drill rod is being raised into position. In addition, this process requires joint coordination between the crew member guiding the one end and the other crew member controlling the winch. In the reverse process of removing the lengths of drill rod, similar amounts of manual labour are needed to control the combination of the drill rod and the winch cable. Sometimes during the raising of a drill string, it becomes necessary to regularly remove drill rods from the drill string and locate those drill rods in a storage rack located beside the mast which may be either located on the same vehicle as the drilling rig or on some adjacent vehicle or on the ground beside the drilling rig.

It is an object of the drill rod handling means, according to the embodiments described herein, to enable drill rods to be picked up from a storage zone 23 located in close proximity to the mast of the drill rig and delivered into position in alignment with the drill string located in the bore hole without the need of a crew member to manipulate and support the drill rod in its movement between the storage zone 23 and drill string and without the use of a winch cable. The drill rod handling means according to the embodiments described herein provides that once the drill rod is in position the drive head, which supports the upper end of the drill rod, the drill string can be engaged with the upper end of the drill rod to enable the drill rod to be lowered into engagement with the upper end of the drill string.

In the example illustrated in FIG. 1, a drill rod handling means 100 is coupled to or integrated with a drill rig 110. The drill rod handling means 100 includes a radial arm 11 and an elongate member support 13. The elongate member support 13 has a first axis X and an elongate extension 17. The elongate extension extends to one side of the elongate member support 13 and is substantially coincidental with the first axis X. The elongate member support 13 comprises a retaining mechanism, such as a pair of clamps 15, which can be spaced longitudinally along an axis parallel to the first axis X and each clamp comprises a pair of clamping elements, which are movable towards and away from each other to selectively engage and retain the side walls of the drill rod 21 and whereby when the drill rod 21 is supported from the elongate member support 13 it is supported to be parallel to and spaced laterally from the first axis X.

The elongate member support 13 also includes an engagement member 19 which is slidably supported upon the extension member 17 to be movable in a direction parallel to the first axis X. The engagement member 19 comprises a further retaining mechanism, such as a clamp, which is operable to enable it to selectively engage and hold the drill rod 21.

The elongate member support 13 is mounted to one end of the radial arm 11 and the other end of the radial arm 11 is mounted to or adjacent to a drill mast 10. The elongate member support 13 is rotatable on the radial arm 11 about a second axis Y, which is transverse to the first axis X and includes a longitudinal axis of the radial arm 11. The radial arm 11 is also capable of pivotal movement with respect to the drill mast 10 about a third axis Z, which is substantially parallel to the axis of the drill mast, and thus the drill string. In one example, the range of pivotable movement of the radial arm 11 about this third axis Z on the drill rig 110 can be approximately two hundred seventy degrees.

A first powered drive 26 is provided between the radial arm 11 and the elongate member support 13 to enable rotation of the elongate member support 13 about the first axis X and a second powered drive 27 is provided between the radial arm 11 and the elongate member support 13 to cause rotation of the elongate member support 13 about the second axis Y. A third powered drive 28 (shown in FIG. 7) is provided to enable the rotation of the radial arm 11 about the third axis Z. The powered drives can take any form of drive and can include hydraulic, pneumatic, electrical, mechanical or a like power source.

In one example, the drill rod handling means 100 is configured to engage drill rods 21 which are positioned in a storage zone 23. The storage zone 23 may be located to one side of the drilling mast 10. The storage zone 23 may be accommodated upon the vehicle 20 supporting the drill rig 110 or upon another vehicle or supported upon the ground or any other suitable structure in close proximity to the drilling mast 10.

The storage zone 23 is defined by any known type of storage mechanism, such as a set of longitudinally spaced U-shaped members 25. The set of longitudinally spaced U-shaped members 25 are capable of rotation about an axis which is located below U-shaped members and which is parallel to the longitudinal axis of the drill rods 21 accommodated within the storage zone 23 and parallel to the first axis X when the elongate member support 13 is located proximate the storage zone 23 and the extension 17 overlies the drill rods 21 therein. The pivotable support enables the set of U-shaped members 25 to be tipped to cause the drill rods 21 to be positioned ready for engagement with the elongate member support 13.

In operation, as illustrated in FIGS. 1-8, the drill rod handling means 100 is configured to engage the drill rod 21 in the storage zone 23, locating the drill rod 21 into the elongate member support 13, lifting the drill rod 21 from the storage zone 23 and then moving the drill rod 21 into position on the mast 10 such that the drill rod 21 is in alignment with the drill string. To affect this action, the radial arm 11 moves into the position shown in FIG. 1. In particular, the radial arm 11 is caused initially to rotate from a position close to the mast 10 about the third axis Z until the elongate extension 17 lies adjacent to one end of the drill rod 21 located in the storage zone 23.

The elongate member support 13 is then caused to rotate about the second axis Y such that the first axis X of the elongate member support 13 is substantially parallel with the longitudinal axes of the drill rods 21 stored in the storage zone 23. The elongate member support 13 is then caused to rotate about the first axis X such that the elongate extension 17 closely overlies the drill rods 21 in the storage zone 23.

The engagement member 19 is then caused to move longitudinally along the elongate extension 17 towards the outer end of the elongate extension 17 and the further clamp of the engagement member 19 is activated to become engaged with the drill rod 21.

Figure 2:
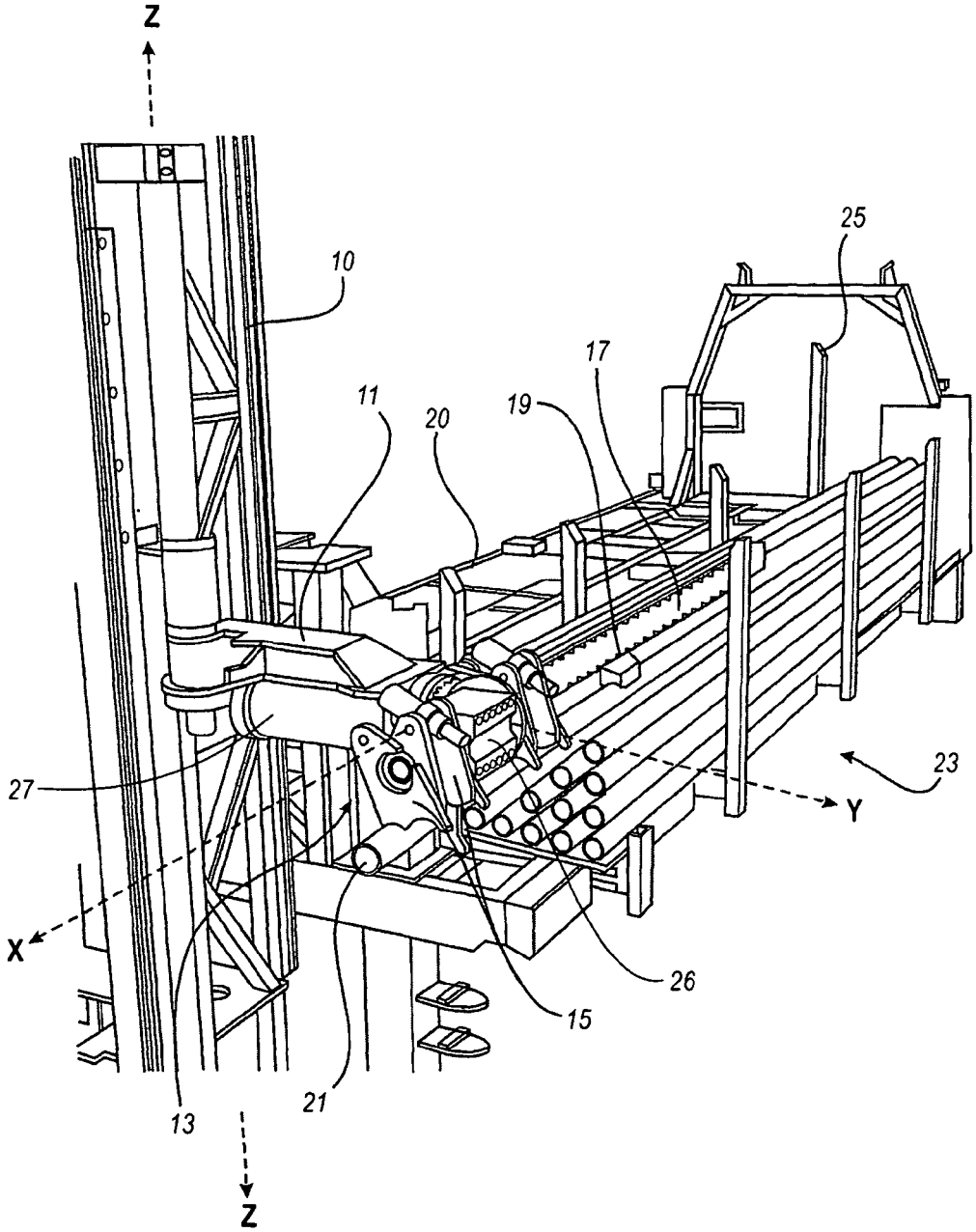
FIG. 2 is an isometric view corresponding to FIG. 1 showing the engagement member in its movement along the elongate member support.
Figure 3:
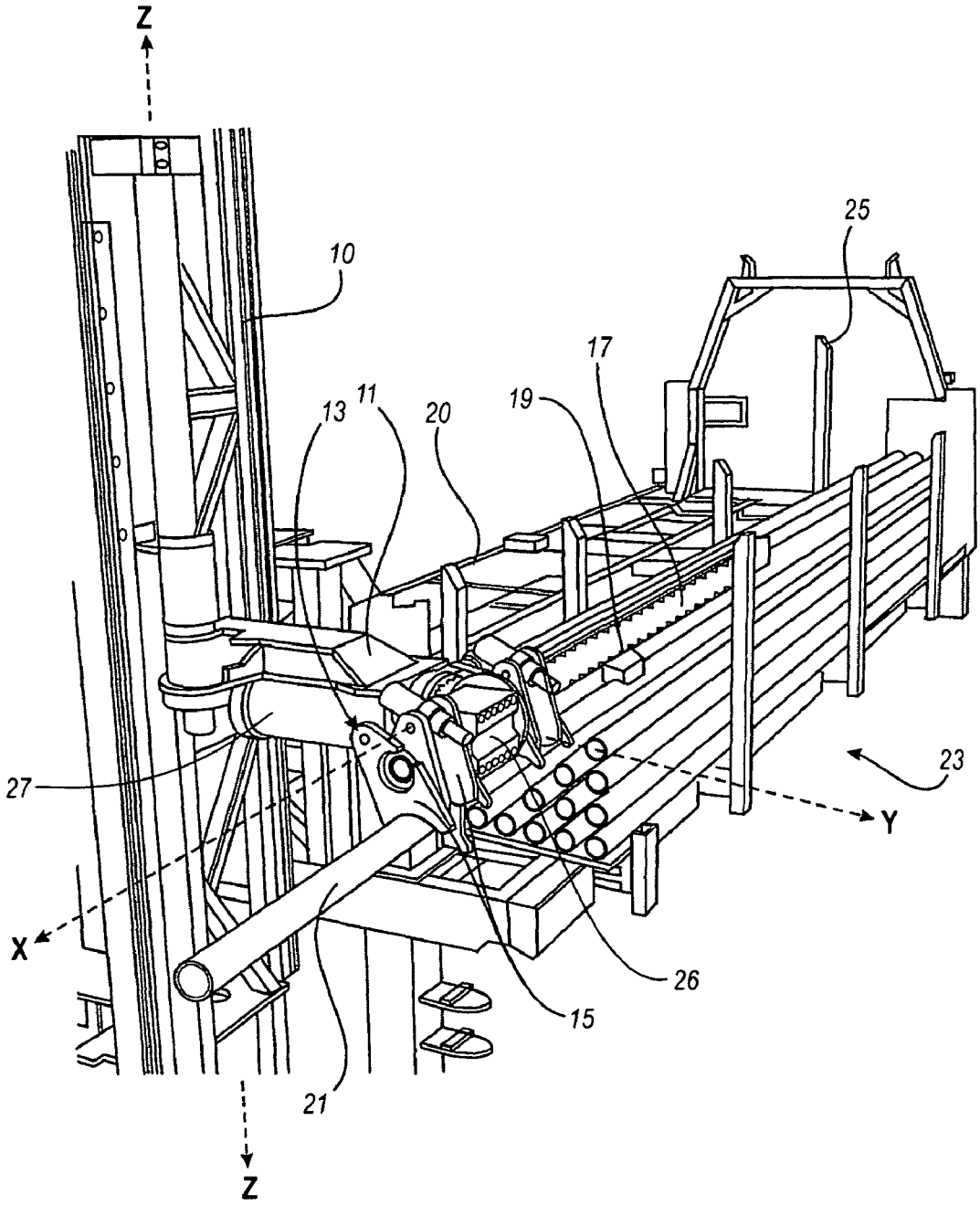
FIG. 3 is an isometric view corresponding to FIGS. 1 and 2 showing the drill rod in its final position on the elongate member support.

The engagement member 19 is then moved longitudinally along the longitudinal extension 17 in the direction of the elongate member support 13, as shown in FIGS. 2 and 3, such that the drill rod 21 enters into position with the disengaged clamping elements of the clamps 15. Once the drill rod 21 is located at the desired position with respect to the elongate member support 13, the clamps 15 then engage the drill rod 21 as shown at FIG. 3.

Figure 4:
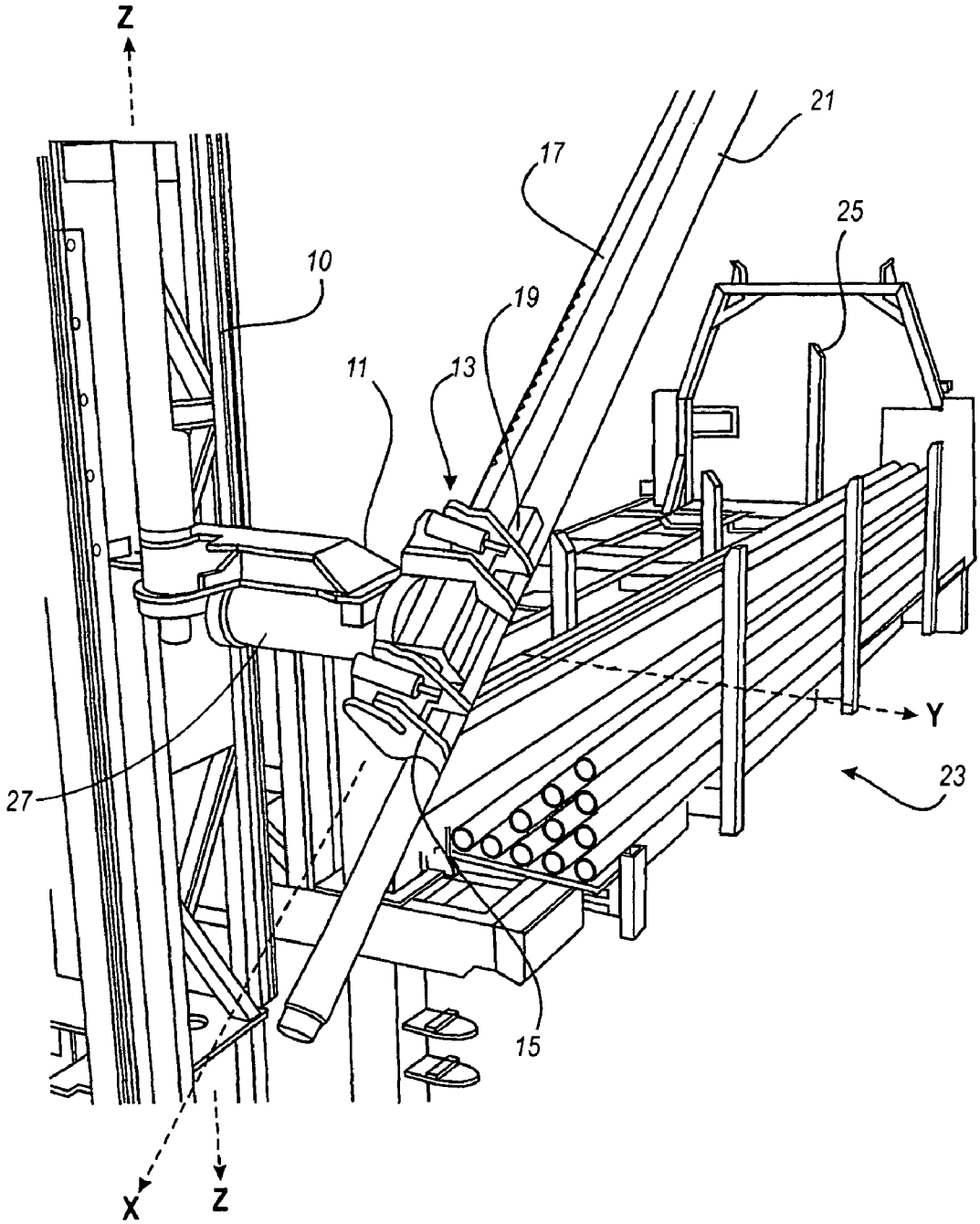
FIG. 4 is an isometric view corresponding to the previous drawings illustrating the drill rod being raised from the storage bin.

Once the drill rod 21 is engaged by the elongate member support 13, it is caused to rotate about the second axis Y to cause the drill rod 21 to be lifted from its substantially parallel position within the storage zone 23 as shown at FIG. 4. Then, the drill rod 21 is ultimately moved to an erect position as shown at FIG. 5, the drill rod 21 located beside the mast 10 and substantially parallel to the mast 10.

Figure 5:
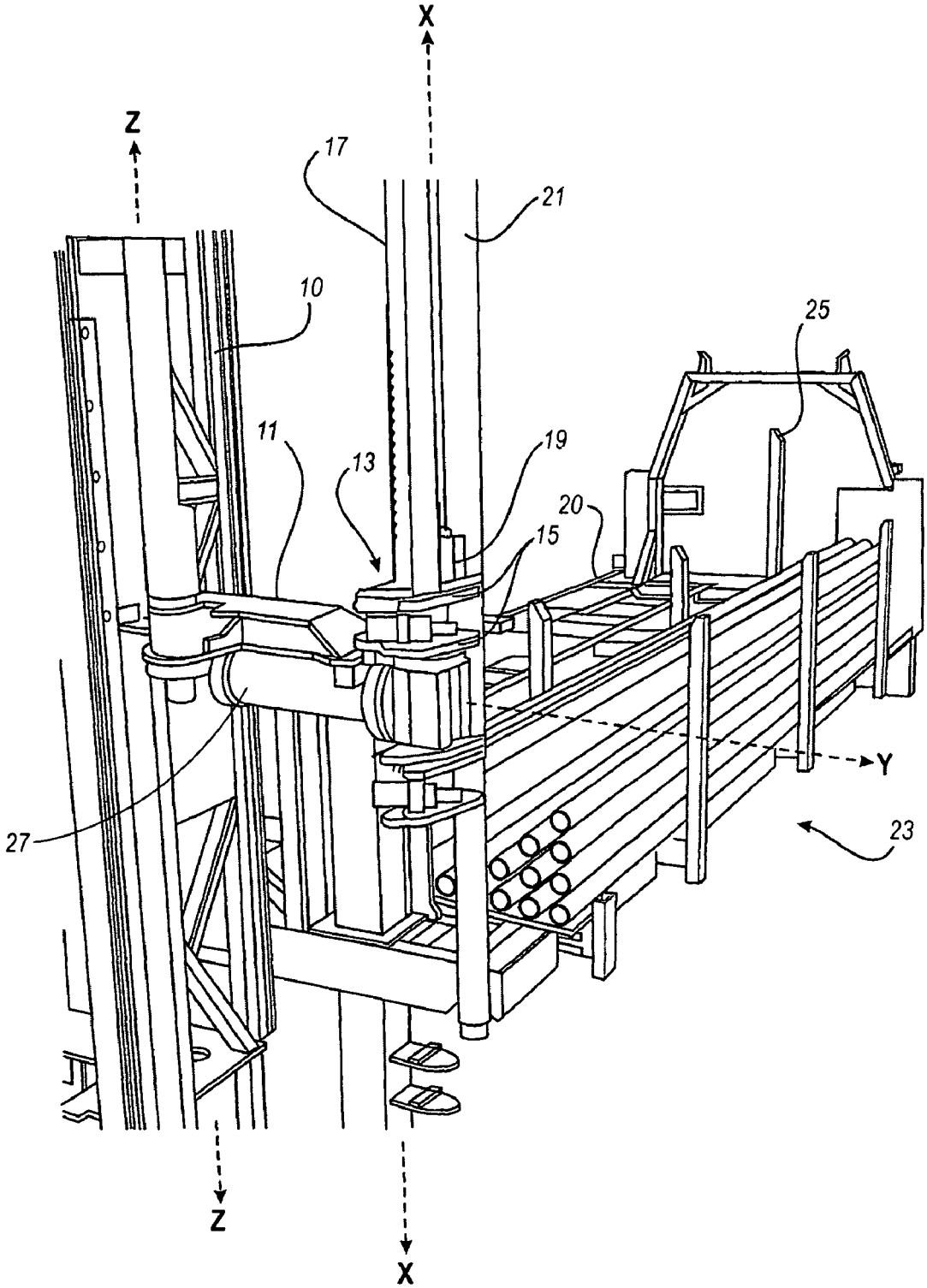
FIG. 5 is an isometric view corresponding to the previous illustrations illustrating the drill rod when raised to its erect position.
Figure 6:
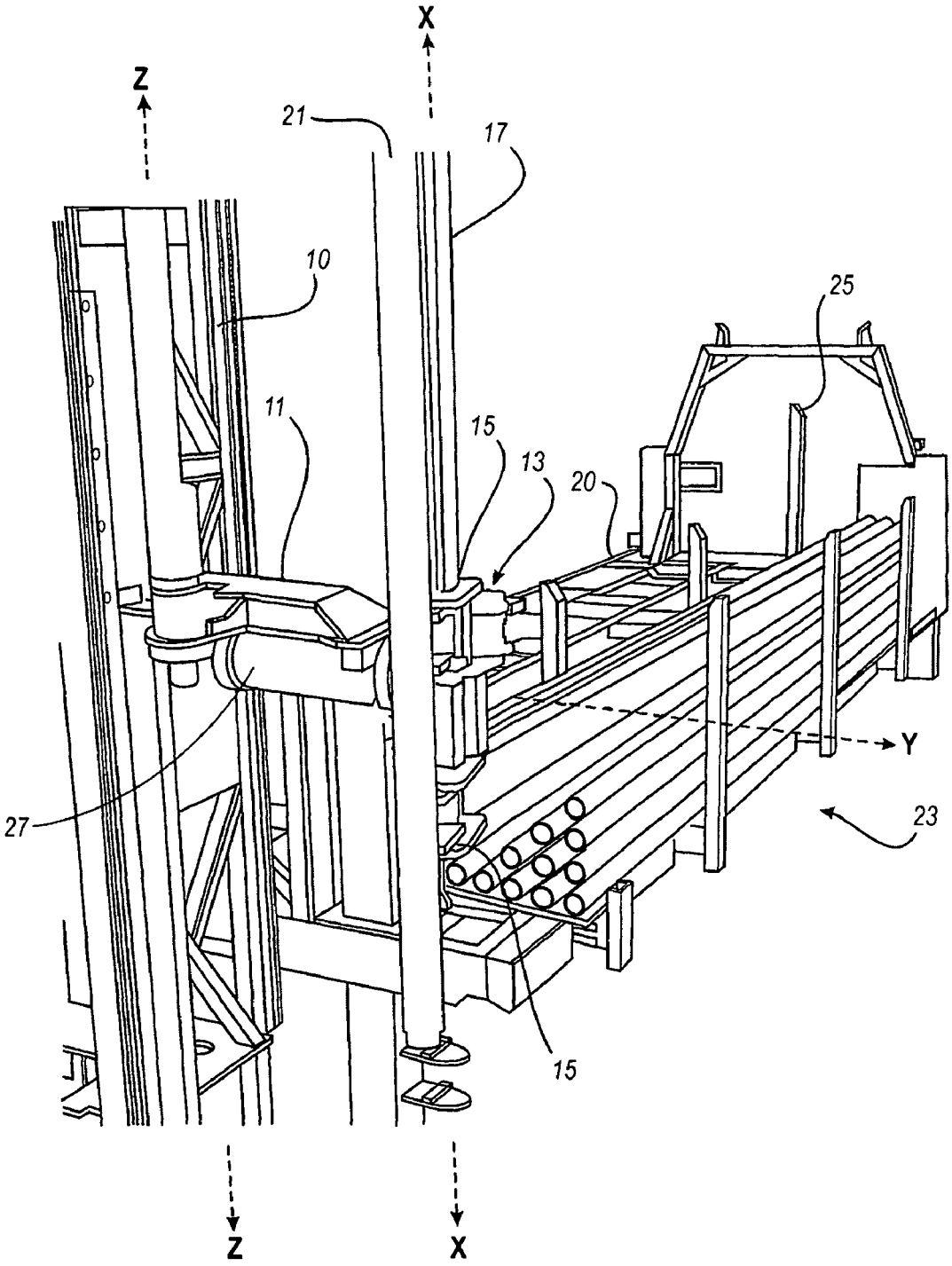
FIG. 6 is an isometric view illustrating the elongate member support having being pivoted about the radial arm about the second axis.

As depicted in the different positions in FIGS. 5 and 6, the elongate member support 13 (and the retained drill rod 21) are then caused to rotate about the first axis X. Because of the transverse displacement of the first axis X from the central axis of the drill rod 21, the drill rod 21 is caused to rotate about the one end of the radial arm 11 to be located at a position that can align with the drill string.

Figure 7:
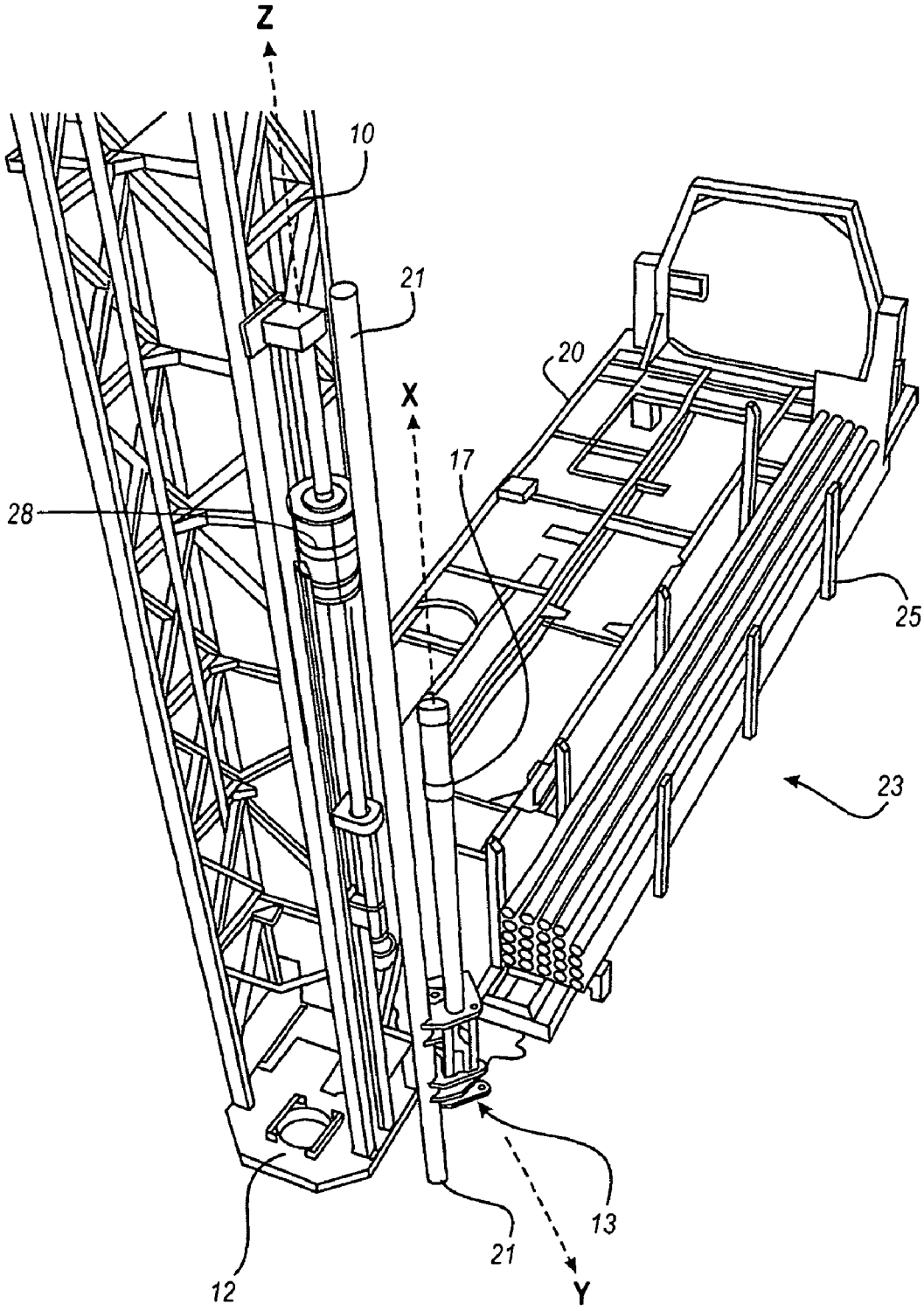
FIG. 7 is an upper isometric view illustrating the radial arm at an intermediate position between its loading positions and its final position.
Figure 8:
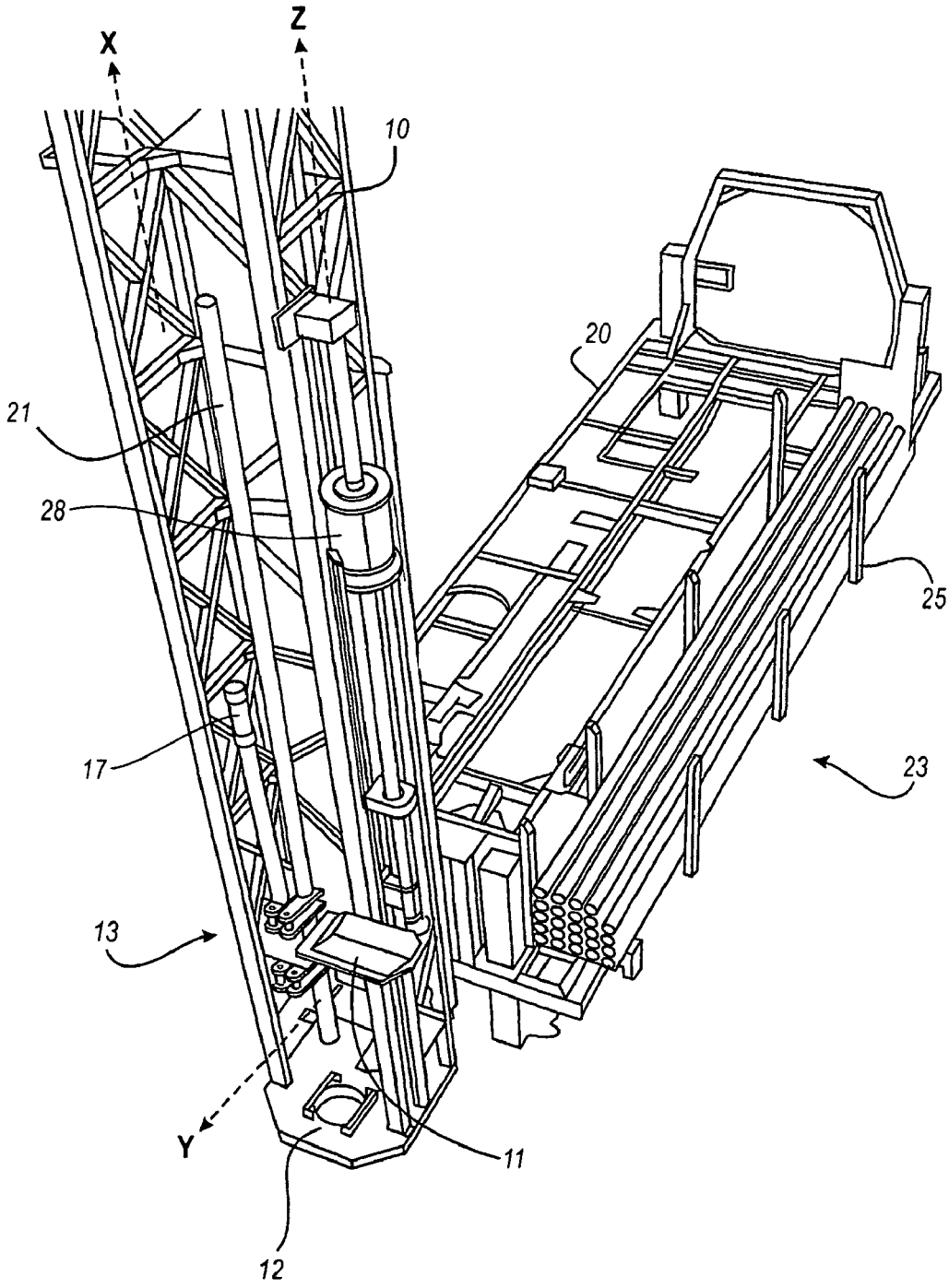
FIG. 8 is an isometric view corresponding to FIG. 7 illustrating the radial arm and drill rod in its final position on the drilling mast.

The radial arm 11 is then caused to rotate about the third axis Z as shown in FIGS. 7 and 8 to bring the drill rod 21 into alignment with the drill string. At this final position the drive head (not shown) of the drill rig 110 can be engaged with the upper end of the drill rod 21 to enable the drill rod 21 to be engaged with the drill string that is located at the bottom of the mast 10. In the engagement of the drill rod 21 with the drill string, the clamping engagement by the clamps 15 may be loosened to allow the drill rod 21 to move slidably through the clamping members 15 while still restrained thereby such that it will maintain the alignment of the drill rod 21 on its movement into an engagement with the drill string.

In order to remove the drill rod 21 from the drill string, the radial arm 11 is initially caused to rotate on the mast 10 about the third axis Z until the clamp 15 is in engagement with the drill rod 21. The clamp 15 is then engaged with the drill rod 21. The radial arm 11 is then caused to rotate on the mast 10 about the third axis Z to bring the outer end of the radial arm 11 proximate to the storage zone 23.

The elongate member support 13 is caused to rotate about the first axis X such that the drill rod 21 supported thereby is located most proximate the storage zone 23. The elongate member support 13 is then caused to rotate on the radial arm 11 about the second axis Y until the drill rod 21 is located above and parallel to the drill rods already accommodated within the storage zone 23.

The engagement member 19 is then moved along the extension member 17 and the further clamp thereof is engaged with the drill rod 21 while the clamp 15 is disengaged therefrom. With movement of the engagement member 19 along to the extension member 17 away from the radial arm 11, the drill rod 21 is located directly above the storage zone 23 and on release from the further clamp, the drill rod 21 is deposited into the storage zone 23.

It should be appreciated that it is a feature of the present invention that the storage zone 23 can be accommodated upon a truck body 20, trailer or a like vehicle which can be located at any position within the range of the two hundred seventy degrees movement of the radial arm 11 on the mast 10.

The Position Sensor System

To prevent the drill rod handling means 100 from accidentally disengaging the drill rod 21 during the above process(es), the drill rod handling means 100 may include a position sensor system that restricts the engagement and/or disengagement of the drill rod 21 to specific positions of the drill rod handler means 100. In particular, for additional safety and reliability, the drill rod handling means 100 may only be allowed to engage and disengage the drill rod 21 when retrieving or returning the drill rod 21 to and from the storage zone 23, which may be within two hundred and seventy degrees of the drill rod handler's rotational arc (shown in FIGS. 1-3), or when coupling or decoupling drill rods to and from the drill string (shown in FIG. 8). In all other positions (shown in FIGS. 4-7) the drill rod handler means 100 may be locked, or otherwise restricted from disengaging the drill rod 21. The position sensor system may have various structural and operational embodiments.

1. The Position Sensor System Structure

Figure 9:
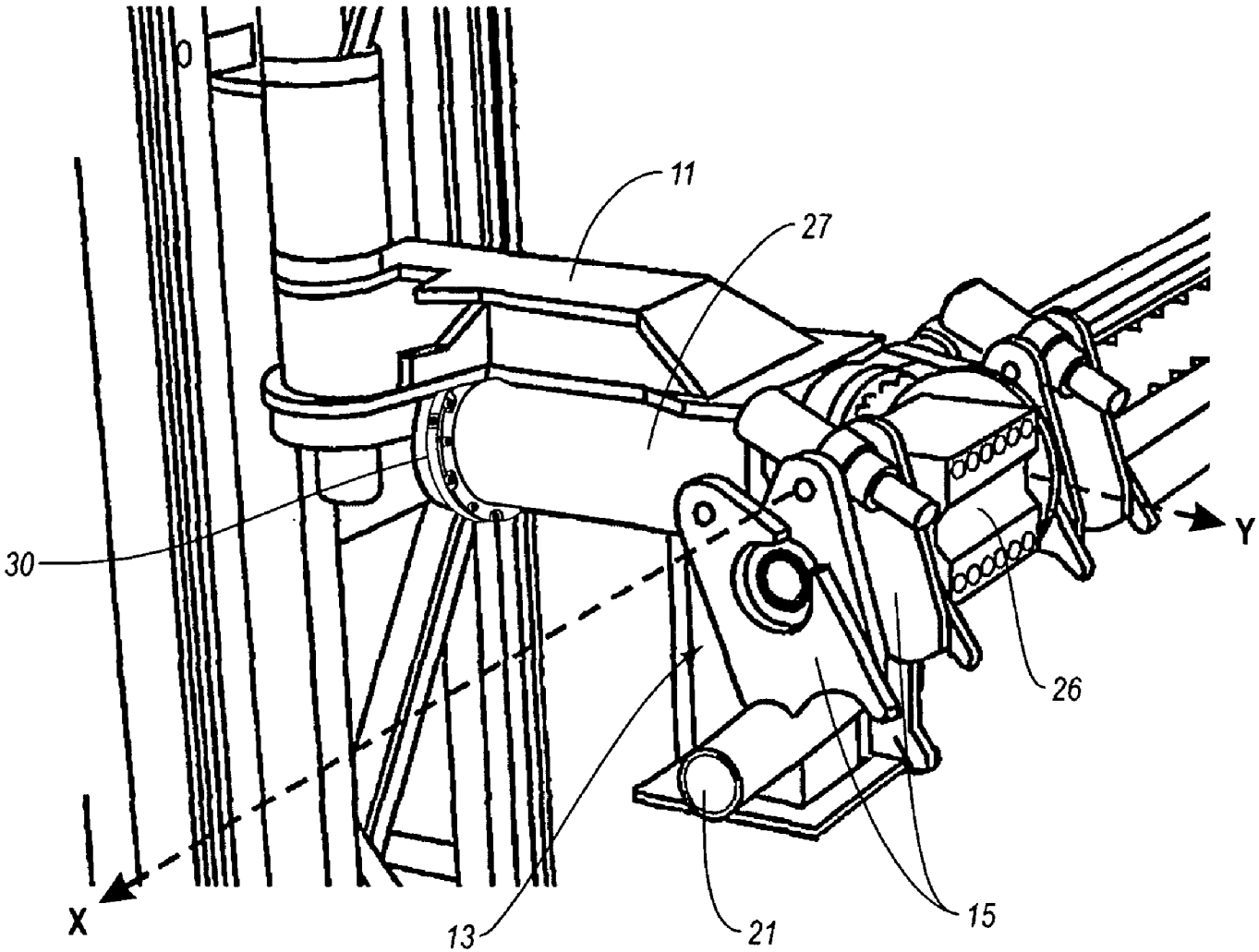
FIG. 9 is an isometric view of the drill rod handler illustrating one possible configuration of the position sensor in an example embodiment of the rod handler.

In one example embodiment, the position sensor system includes a control center (not shown) that is communicably linked to two position sensors. As illustrated in FIG. 9, for example, a first position sensor may be a level sensor 30 that is attached to the second powered drive 27 such that the level sensor 30 rotates in tandem with the elongate member support 13 about the second axis Y. An example of a second position sensor is illustrated in FIG. 10, and may be a rotation sensor 50 that is mounted on the third powered drive 28 used to rotate the elongate member support 13 about the third axis Z.

Figure 10:
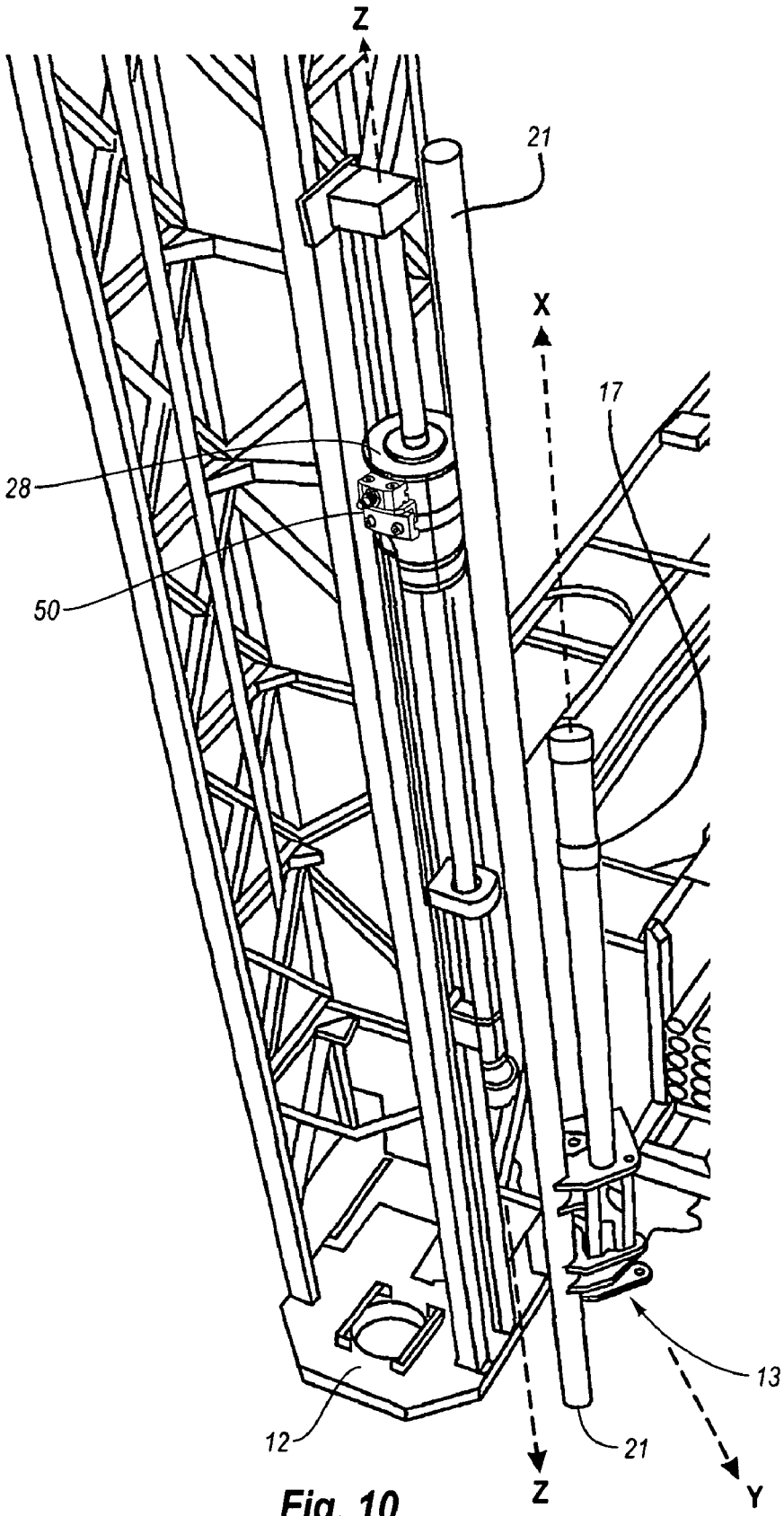
FIG. 10 is an isometric view of the drill rod handler illustrating one possible configuration of a second position sensor.

FIGS. 9 and 10 demonstrate only one example embodiment of the position sensor system, and the characteristics of the position sensor system may vary from one embodiment to the next. For example, the location of the level sensor 30 and the rotation position sensor 50 may vary. In one example embodiment, the level sensor 30 may be located directly on the elongate member support 13, while in yet another example embodiment the level sensor 30 may be integral with the second powered drive 27 such that the level sensor 30 is partially or substantially enclosed within the second powered drive 27.

As with the level sensor 30, the rotation position sensor 50 may also be situated in a variety of locations. For example, the rotation position sensor 50 may be integral with the third powered drive 28 such that the rotation position sensor 50 is substantially enclosed within the third powered drive 28. In another example embodiment, the rotation position sensor 50 may be positioned anywhere along the drive shaft of the third powered drive 28 such that the rotation sensor 50 can interact with triggers placed on the drive shaft or on other parts of the drive assembly that rotate in tandem with the third powered drive 28.

Just as the location of the position sensors may vary, the number of position sensors used in the position sensor system may vary as well. For example, FIGS. 9 and 10 illustrate one example embodiment that includes two position sensors. In another example embodiment, an additional position sensor may be coupled with the first powered 26 drive such that the control center also receives position information of the drill rod handler means 100 with respect with the first axis X. Other example embodiments may include more position sensors that indicate various other positions of the drill rod handler means 100, such as intermediate positions between the storage zone 23 and the drill rod string.

With an increase in the number of position sensors, the type of sensor used may vary depending on how the additional sensors are utilized. In addition to the level sensor 30 that indicates a position relative to gravity, and the rotation sensor 50 that indicates a rotational position, a linear type positioning device may be incorporated into the position sensor system. In one example embodiment, a linear type position sensor may correspond to the position of engagement member 19 as the engagement member 19 moves in a linear path parallel to the first axis X.

Thus, the location, number, and types of position sensors may vary from one embodiment of the position sensor system to the next depending on variables such as required installation space, the number of positions desired to monitor, and the nature of the movement.

2. Operation of the Position Sensor System

Figure 11A:
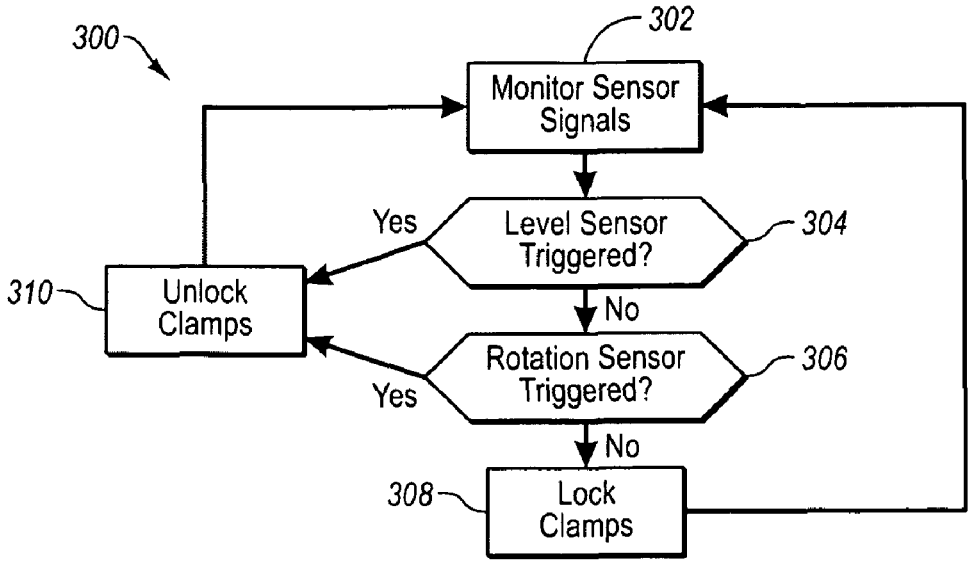
FIG. 11A illustrates an example schematic of handling a drill rod.

In operation, the position sensor system utilizes a control center (not shown) that communicates with the position sensors 30, 50. FIG. 11A is a schematic that illustrates one operational example of the position sensor system 300. In particular, the position sensor system 300 monitors the sensor signals 302 generated by the position sensors 30, 50. As previously discussed, a control center (not shown) may be used to monitor the sensor signals 302. The control center monitors the sensor signals 302 to determine whether the level sensor is triggered 304 or whether the rotation sensor is triggered 306. If the level sensor is not triggered and the rotation sensor is not triggered, then the control center locks the clamps 308, thus not allowing the clamps to disengage the drill rod. Conversely, if either the level sensor or the rotation sensor are triggered, then the control center unlocks the clamps 310 such that the clamps may disengage or engage the drill rod.

Figure 11B:
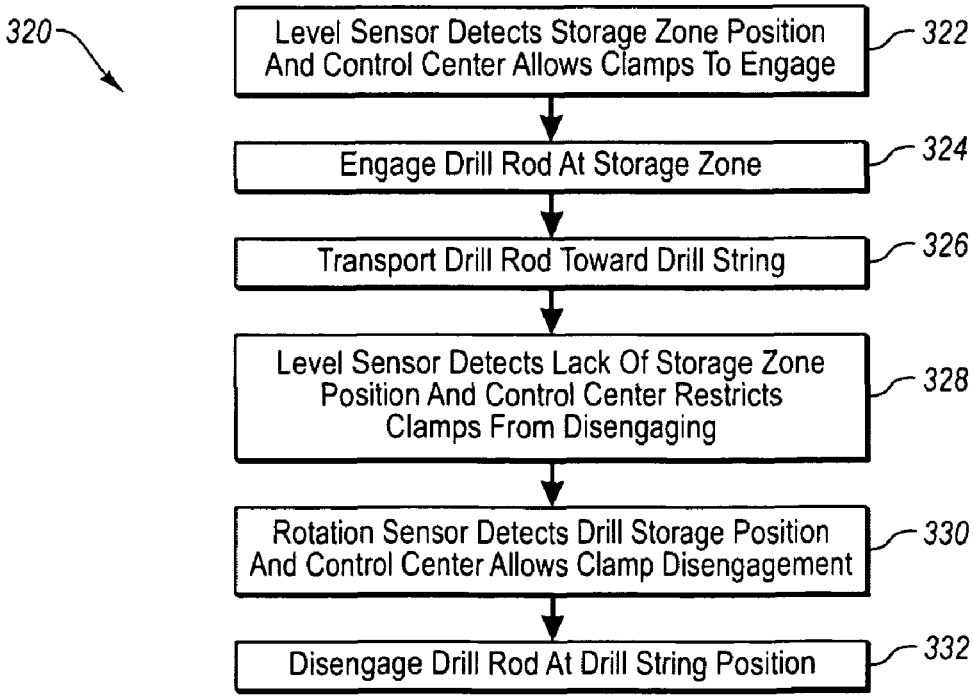
FIG. 11B illustrates an example method of handling a drill rod.

FIG. 11B illustrates one example of a method 320 of transporting the drill rod 21 from the storage zone 23 to the drill string using a position sensor system including both the level sensor 30 and the rotation sensor 50. As an overview, the net effect of the method 320 is that the clamps 15 are only allowed to engage or disengage the drill rod 21 when retrieving or returning the drill rod 21 to the storage zone 23, or when facilitating the coupling or decoupling of the drill rod 21 to or from the drill string. Otherwise, the clamps 15 are restricted from disengaging the drill rod 21, thus preventing an undesired drop of the drill rod 21.

The method 320 may include the act of the level sensor detecting a storage zone position and the control center permitting the clamps to engage a drill rod 322. For example, the level sensor 30 may detect when the elongate member support 13 is in a position to retrieve the drill rod 21 from the storage zone 23, such as a substantially horizontal position as shown in FIGS. 1-3.

FIG. 11B illustrates the method 320 may further include the act of engaging the drill rod at the storage zone 324. For example, upon the level sensor 30 communicating the substantially horizontal position of the elongate member support 13, the control center may allow the clamps 15 to engage the drill rod 21 located in the storage zone 23.

Additionally, the method 320 may include the act of transporting the drill rod toward the drill string 326. For example, the elongate member support 13 may rotate about the second axis Y, as shown in FIG. 4, and about the third axis Z, as shown in FIGS. 5-7.

FIG. 11B further illustrates that the method 320 may include the act of the level sensor detecting a lack of the storage zone position and the control center restricting the clamps from disengaging 328. For example, upon the elongate member support 13 rotating about the second axis Y, the level sensor 30 may communicate to the control center that the elongate member support 13 is no longer in a substantially horizontal position. The control center then locks or otherwise restricts the clamps 15 from disengaging the drill rod 21.

The method 320, as illustrated in FIG. 11B, also may include the act of the rotation sensor detecting a drill string position 330. For example, the rotation sensor 50 can be configured to communicate to the control center when the elongate member support 13 is positioned to facilitate the coupling of the drill rod 21 to the drill string. Hence, if the position of the elongate member support 13 is not in position to facilitate the coupling of the drill rod 21 to the drill string, then the clamps 15 remain locked or otherwise restricted from disengaging the drill rod 21.

Additionally, the method 320 may include the act of disengaging the drill rod at the drill string position 332. For example, when the elongate member support 13 is positioned to facilitate the coupling of the drill rod 21 to the drill string, as shown in FIG. 8, then the rotation sensor 50 indicates this position to the control center, and the control center subsequently unlocks or otherwise allows the clamps 15 to disengage the drill rod 21 to facilitate the coupling of the drill rod 21 to the drill string.

Conversely, in other embodiments of the method 320, the method may include acts that allow the drill rod 21 to be transported from the drill string to the storage zone 23. For example, when retrieving the drill rod 21 from the drill string, the rotation sensor 50 communicates to the control center that the elongate member support 13 is positioned to engage the drill rod 21 at the drill string. The control center thus allows the clamps 15 to engage the drill rod 21. Once the drill rod 21 is moved away from the drill string (i.e., rotated about the third axis Z away from the mast 10), then the rotation sensor 50 communicates the drill rod 21 position to the control center, and the control center subsequently locks or otherwise restricts the clamps 15 from disengaging the drill rod 21.

Furthermore, when returning the drill rod 21 to the storage zone 23, the level sensor 30 sends a signal to the control center when the elongate member support 13 is in a substantially horizontal position. The control center subsequently unlocks or otherwise allows the clamps 15 to disengage the drill rod 21 to facilitate the return of the drill rod 21 to the storage zone 23.

In addition to controlling the function of the clamps 15, the position sensor system may control other functions of the drill rod handler 100. For example, in one embodiment position sensors could be configured to communicate to the control center the position of the clamps. The control center may then restrict the elongate member support 13 from rotating away from a horizontal position when a position sensor indicates that the clamps are in a disengaged position. Other function and position combinations may vary from one embodiment to the next depending on the desired function and control with regards to the position of one or more components of the drill rod handler 100.

In fact, the control center may be programmed to provide a fully automated drill rod handler 100, thus limiting the need for a human operator. For example, the entire method of transporting the drill rod, as shown in FIG. 11, could be automated and performed solely with a programmed control center as part of a position sensor system. Other example embodiments may incorporate partial automation where only particular functions are performed by a programmed control center, while other functions require a human operator.

The automation configurations of the position sensor system may depend on how the position information is communicated to the control center. In one example, the position sensors are physically linked to the control center through a wire or other physical electrical connection, thus allowing an electrical signal to be sent from the position sensors to the control center. In other embodiments, a wireless link may be established such that the position sensors can send a signal by way of a radio wave, or other wireless signal, directly to the control center. A control center may also be configured to receive signals from both physically linked position sensors, as well as wirelessly linked position sensors.

In the case of a wireless position sensor system, the physical location of the control center may vary. For example, in one embodiment, the control center may be located directly on the drill rod handler 100. However, in another example embodiment, the control center may be located anywhere the control center can receive the wireless signal, including a location off of the drill rod handler 100 itself. Moreover, a wireless control center may be configured to receive wireless signals from more than one piece of equipment, thus allowing the control center to coordinate the function of several pieces of equipment simultaneously.

Level Sensor

Just as there are many embodiments of the overall position sensor system, there are a variety of embodiments of the individual position sensors. For example, the level sensor 30 may have a variety of structural and operational embodiments.

1. Structure of the Level Sensor

Figure 12:
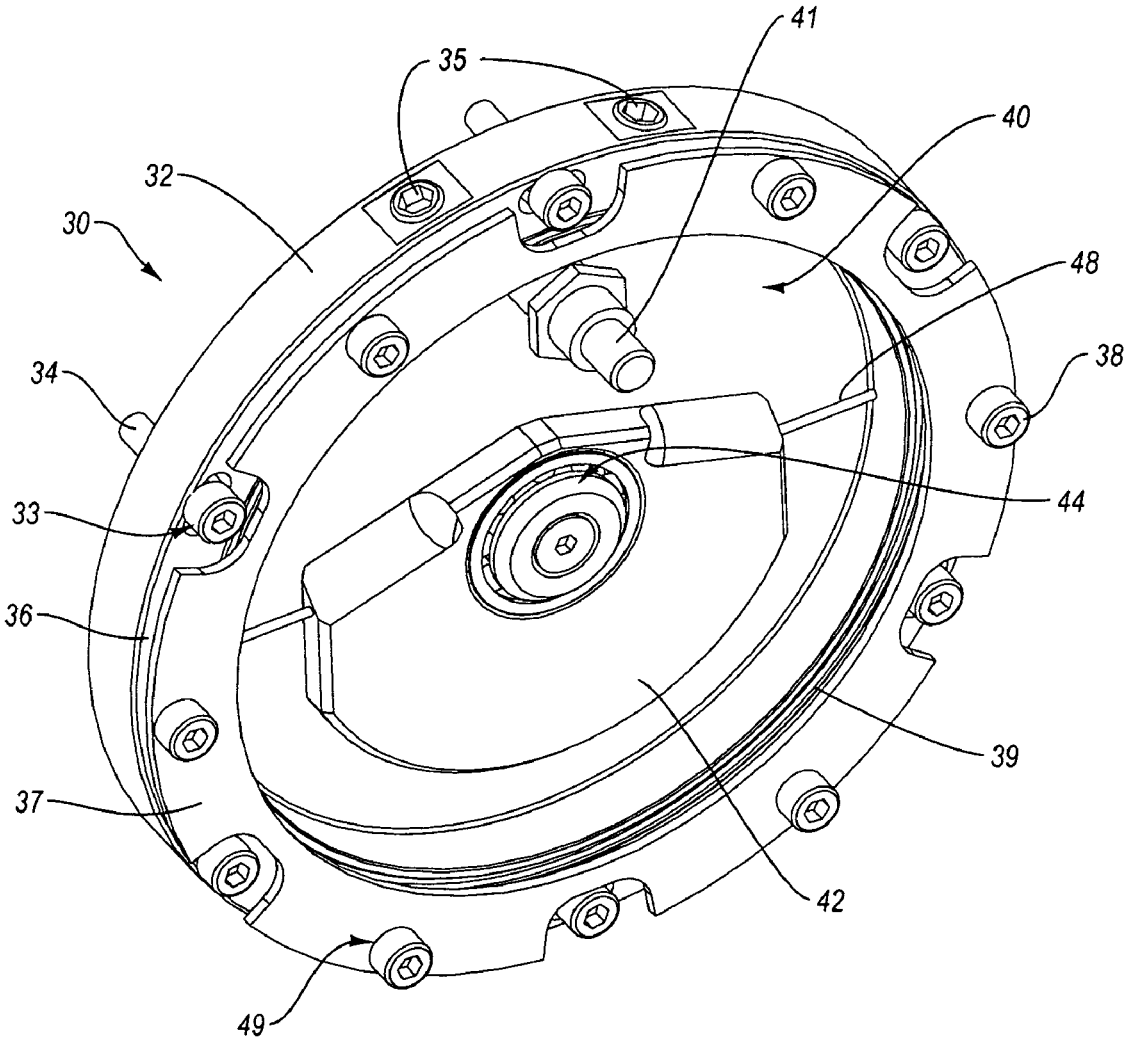
FIG. 12 is an isometric view of an example embodiment of the level sensor.
Figure 13:
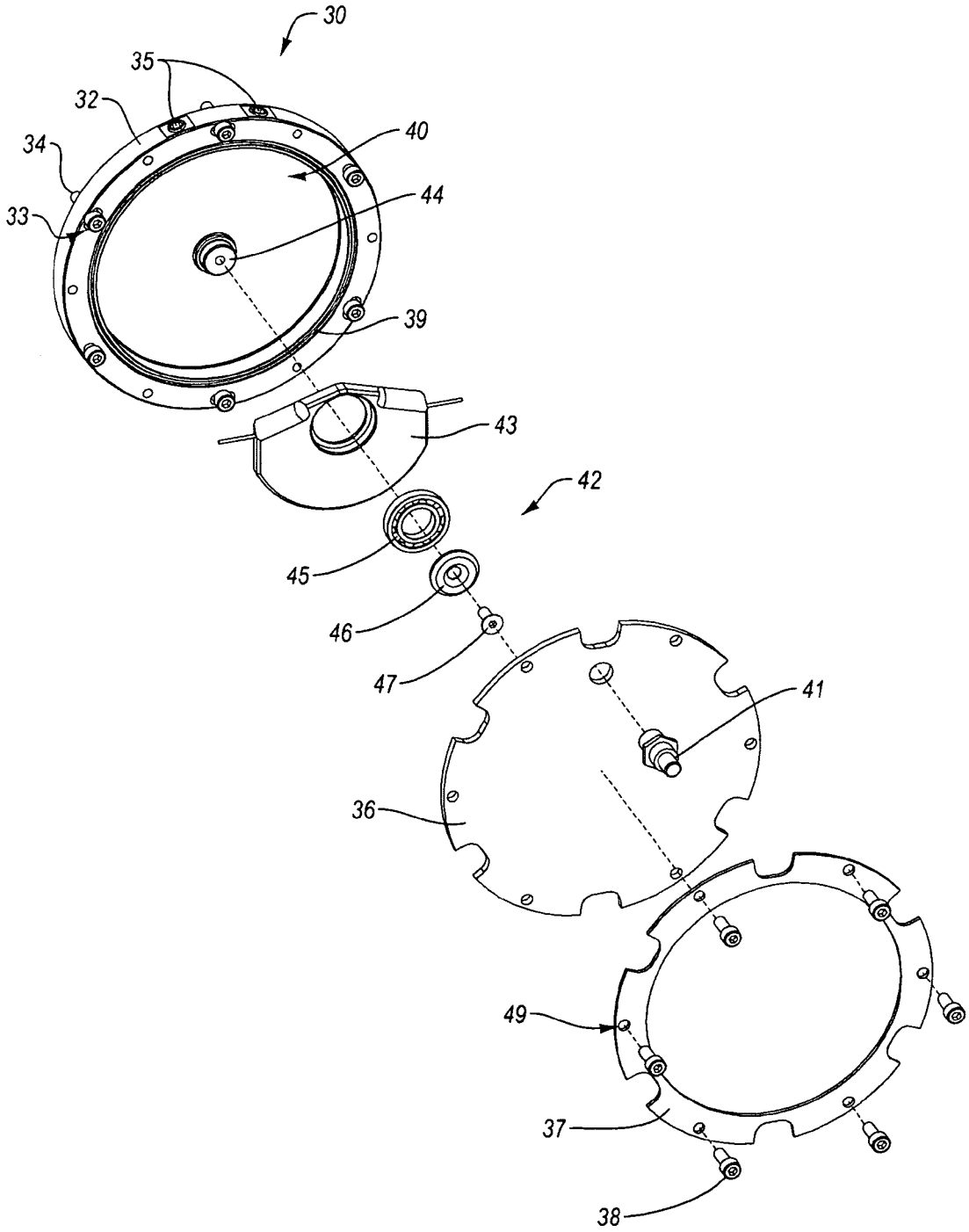
FIG. 13 is an exploded view of an example embodiment of the level sensor.

One example embodiment of the level sensor 30 is shown in FIGS. 12 and 13. In this embodiment, the level sensor 30 includes a housing 32. The housing 32 includes a plurality of housing fastener ports 33 defined therein through which housing fasteners 34 extend. The housing 32 further includes drain/fill ports 35. A faceplate 36 is secured to the housing 32 by way of a faceplate retainer 37. The faceplate retainer 37 contains a plurality of faceplate ports 49 that align with corresponding ports in the faceplate 36 and the housing 32, and through which faceplate fasteners 38 extend and secure the faceplate 36 to the housing 32. A seal 39 is positioned between the housing 32 and the faceplate 36, the housing 32 and the faceplate 36 forming an enclosure 40. A pendulum assembly 42 is rotationally attached to the housing 32 such that the pendulum assembly 42 can rotate within the enclosure 40 about a hub 44. A proximity switch 41 extends through the faceplate 36 and into the enclosure 40.

Briefly, in operation, the level sensor 30 may be attached to the second powered drive 27 such that the level sensor 30 rotates about the second axis Y at substantially the same rate as the elongate member support 13. As the level sensor 30 rotates, the pendulum assembly 42 freely rotates about the hub 44 and maintains a generally constant position with respect to gravity. When the elongate member 13 is in a substantially horizontal position, as shown in FIGS. 1-3, a trigger 48 attached to the pendulum assembly 42 contacts the proximity switch 41. Upon contact with the trigger 48, the proximity switch 41 sends a signal or otherwise communicates to the control center (not shown), indicating the elongate member support 13 is in a substantially horizontal position. Alternatively, if the elongate member support 13 is rotated away from the substantially horizontal position, then the level sensor 30 also rotates. As the level sensor 30 rotates, the pendulum assembly 42 maintains a generally constant position with respect to gravity, and the trigger 48 comes out of contact with the proximity switch 41. The proximity switch 41 subsequently communicates to the control center that the elongate member support 13 is no longer in a substantially horizontal position.

The components of the level sensor 30, and characteristics of each component, may vary from one embodiment to the next. For example, the housing is one component that may vary. FIGS. 12 and 13 illustrate one example embodiment showing various geometric characteristics of the housing 32. For example, the housing 32 shown in FIGS. 12 and 13 is a circular disk with an outer diameter lip that creates a shallow cup shape. Other example housing 32 shapes may be square, rectangular, triangular, or any other shape or combination of shapes so long as the housing 32 shape facilitates the free rotation of the pendulum assembly 42.

Along with the shape of the housing 32, the size of the housing 32 is another geometric characteristic that may vary from one embodiment to the next. For example, FIG. 9 illustrates one embodiment of the housing 32 where the size of the housing 32 is made to roughly cover the same size area as the end of the second powered drive 27. In other embodiments, the housing 32 size may differ to facilitate various mounting locations on the drill rod handler 100. For example, the size of the housing 32 may be smaller such as to fit inside a powered drive.

In addition to varying geometric characteristics of the housing 32, the material characteristics of the housing 32 may also vary. In one example embodiment, the housing 32 is made from steel, such as stainless steel. However, in other embodiments, a housing can be made from a variety of materials, including other various metals, composites, plastics, or any combination thereof.

The housing 32 material used may partially determine the construction of the housing 32. For example, FIG. 13 shows one example embodiment where the housing 32 is made from a single piece of material. In another example embodiment, a housing may be constructed from multiple pieces of material that are attached together with mechanical means (e.g., fasteners, screws), or by chemical means (e.g., welding, glue or other chemical bond). Moreover, in a multiple piece housing design, the various pieces of material may differ one from another.

Notwithstanding the material and construction of the housing 32, various design elements of the housing may vary from one embodiment to the next. One housing 32 design element that may vary is the housing fastener ports 33 through which housing fasteners 34 extend. In one example embodiment, shown in FIG. 12, the housing fastener ports 33 are located on the outside perimeter of the housing 32. However, in other example embodiments, housing fastener ports 33 may be located in many location so long as the housing fastener ports 33 and the corresponding housing fasteners 34 do not interfere with the rotation of the pendulum assembly 42.

Just as the location of the housing fastener ports 33 may vary, the size of the housing fastener ports 33 may also vary from one embodiment to the next. FIG. 12 shows one example embodiment where the housing fastener ports 33 are a substantially oblong shape such as to provide clearance between the housing fastener port 33 and the housing fastener 34. This clearance allows the housing 32 to be rotated, or otherwise adjusted to different positions, thus affecting the position of the proximity switch 41. This adjusting design facilitates a wide range of detectable positions with respect to level. In another example embodiment, the housing fastener ports 33 may be larger such as to facilitate larger adjustments.

In fact, in one example embodiment, a single large housing fastener port 33 may be designed into the housing to allow for an almost full three hundred sixty degree rotation of the housing 32. In larger housing fastener ports 33, a plurality of housing fasteners 34 may extend through the same housing fastener port 33. In yet another embodiment, housing fastener ports 33 may only allow room for single housing fasteners 34 and provide clearance with the housing fasteners 34 such that the housing 32 is not adjustable.

As suggested above, the size of the housing fastener ports 33 may determine the number of housing fastener ports 33. In one example embodiment, shown in FIG. 12, there are six housing fastener ports 33 located approximately every sixty degrees around the circumference of the housing 32. However, in other example embodiments, there may be more or less housing fastener ports 33 depending on the number of housing fasteners 34 required to securely hold the housing 32 to the drill rod handler 100, or depending on the size of the housing fastener ports 33 themselves.

The various characteristics of the housing fastener ports 33 may determine the characteristics of the housing fasteners 34, which may vary from one embodiment to the next. One housing fastener 34 characteristic that may vary is the type of fastener. In one example embodiment, shown in FIG. 12, the housing fasteners 34 are threaded fasteners that can be tightened or loosened to connect, disconnect, or adjust the position of the housing 32. In other embodiments, housing fasteners 34 may be rivet-type fasteners. Mechanical housing fasteners 34 may not necessarily be employed, and in other embodiments the housing 32 may be attached to the drill rod handler 100 with glue or welding.

In addition to the housing fastener ports 33 and housing fasteners 34, the drain/fill ports 35 are another design aspect of the housing 32 that may vary from one embodiment to the next. For example, as shown in FIG. 12, two drain/fill ports 35 are located in the same quadrant along the perimeter housing 32. In this arrangement, one drain/fill port 35 may be used to pass a liquid in or out of the level sensor 30, while the other drain/fill port 35 facilitates air movement in or out of the level sensor 30. In another example embodiment, there may be a plurality of drain/fill ports such as to facilitate the draining and/or filling of the level sensor 30 regardless of the orientation of the housing 32.

One reason to introduce a liquid into the level sensor 30 is to maintain a consistent pendulum assembly 42 rotation about the hub 44. The hub 44 is another example of a design aspect of the housing 32 that may vary. In one example embodiment, shown in FIG. 13, the hub 44 is integral with the housing 32 and formed out of the same piece of material. In another example embodiment, the hub 44 may be cooperatively attached to the housing 32 and made from a separate piece of material that differs from the material of the housing 32.

Figure 14:
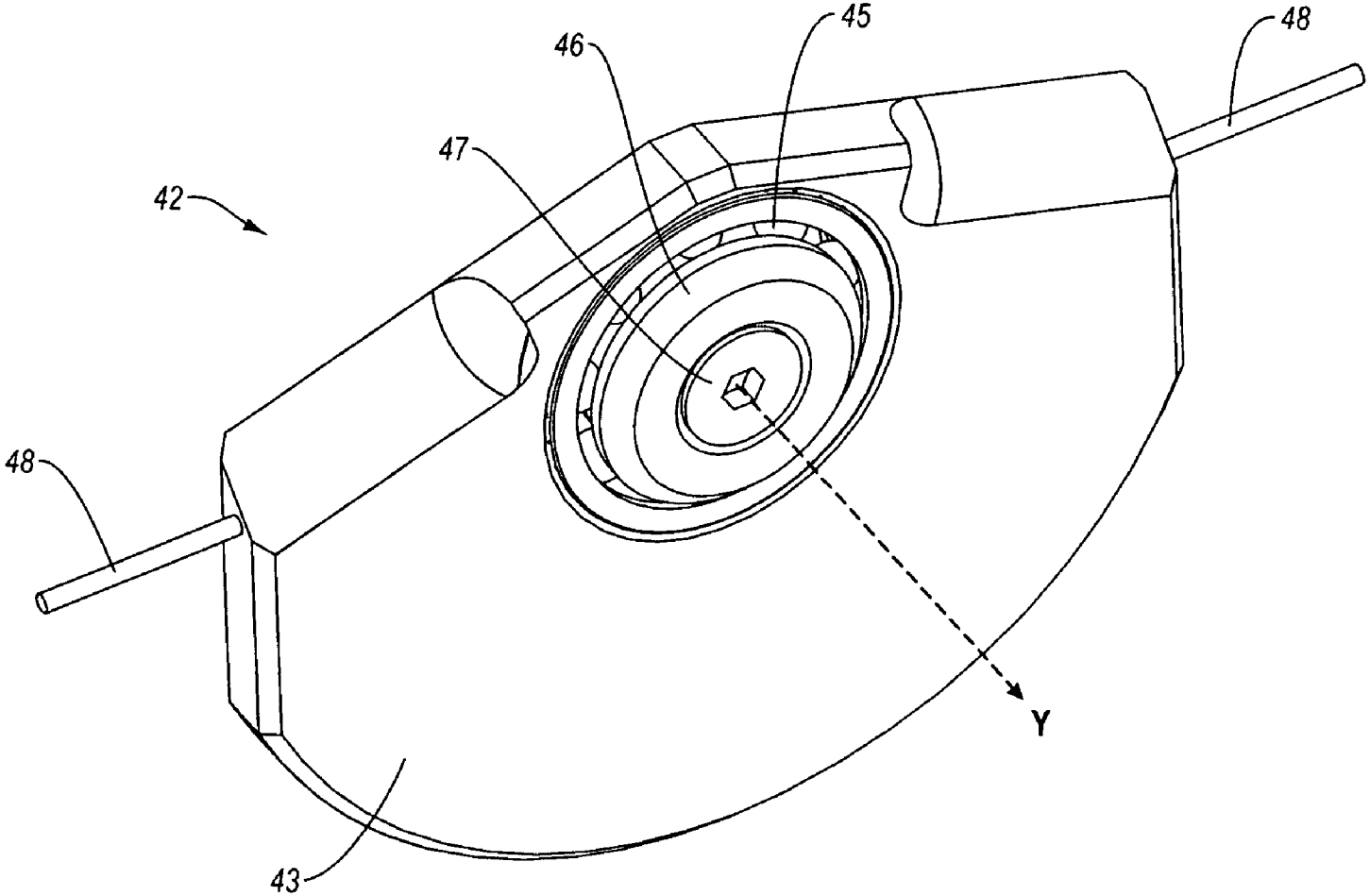
FIG. 14 is an isometric view of an example embodiment of the pendulum assembly that may be used in the level sensor.

The hub 44 is designed to support the pendulum assembly 42, as illustrated in FIG. 12. For example, FIGS. 13 and 14 show one embodiment of the pendulum assembly 42, which includes a pendulum body 43 that is configured to accept a ball bearing insert 45. The ball bearing insert 45 has an inner diameter that substantially corresponds to the outer diameter of the hub 44. The outer diameter of the hub 44 engages the inner diameter of the ball bearing insert 45 such that the ball bearing insert 45 facilitates the rotation of the pendulum body 43 about the axis of the hub 44. The ball bearing insert 45 is secured on the hub 44, and within the pendulum body 43, by a ball bearing retainer ring 46 in combination with a retainer fastener 47.

The pendulum assembly 42, including pendulum assembly 42 components, may vary from one level sensor 30 embodiment to the next. One example of a pendulum assembly 42 component that may vary is the pendulum body 43. For example, the shape of the pendulum body 43 may vary. In FIG. 14 the pendulum body 43 has a substantially semi-circular body shape. Nevertheless, the pendulum body 43 shape may vary from one embodiment to the next and include shapes that are more rectangular, square or triangular so long as the pendulum body 43 shape provides the necessary weight distribution to allow the pendulum assembly 42 to freely rotate about the hub 44.

To achieve proper weight distribution, various pendulum body 43 material(s) may be used. Some example pendulum body 43 materials include metals such as steel. However, the pendulum body 43 can be any material, or combination of materials, so long as the weight distribution allows the pendulum assembly 42 to freely rotate about the hub 44. For example, the upper portion of the pendulum body 43 may be made from a plastic, while the bottom weighted portion of the pendulum body 43 is made from heavier material, such as a metal.

In addition to the various shape and material combinations, the pendulum body 43 may also have various trigger configurations. In one example embodiment, the pendulum body 43 is the trigger. In other words, when the pendulum body 43 contacts the proximity switch 41, or comes within a certain distance of the proximity switch 41, the proximity switch 41 sends a signal to the control center. The pendulum assembly 42 may additionally include triggers 48 that are connected to the pendulum body 43. For example, FIG. 14 illustrates one example embodiment that includes two triggers 48 attached to the pendulum body 43. In this example, the triggers 48 are arranged parallel to level, or in other words, the triggers 48 are perpendicular to gravity.

Other embodiments of the pendulum assembly 42 include various trigger 48 configurations that vary in both the number of triggers 48 used, as well as the location of the trigger(s) 48 attached to the pendulum body 43. In particular, another example embodiment may include three triggers, two triggers 48 arranged as illustrated in FIG. 14, and the third trigger arranged to run parallel with gravity. In this embodiment, the third trigger would provide for the detection of a vertical position, i.e., when the elongate member support is holding the drill rod in a vertical position (as shown in FIGS. 5-8). Any number of additional triggers may be arranged in different positions Mon the pendulum body to detect various positions as desired.

Not only can the number and arrangement of the triggers 48 vary, but other trigger 48 characteristics may also vary. For example, each trigger 48 may be made from a variety of materials depending on the type of proximity switch 41 used on the level sensor 30. For example, the triggers 48 may be made from a material that is magnetic, inductive, or have a certain capacitance such that when the triggers 48 are within a specified distance of the proximity switch 41, or come into contact with the proximity switch 41, the proximity switch 41 can detect the trigger 48.

Moreover, in an embodiment where the triggers 48 contact the proximity switch 41, the triggers 48 may be made of a flexible material that allows the triggers 48 to bend around the proximity switch 41 upon rotation of the pendulum assembly 42. In other example embodiments, the triggers 48 may be more rigid, such that once the trigger 48 comes in contact with the proximity switch 41, the trigger 48 remains in contact with the proximity switch 41 until the pendulum assembly 42 rotates in the direction away from the proximity switch 41.

In addition to varying the trigger 48 material, the geometric shape of the triggers 48 may also vary. FIG. 14 shows one example embodiment where the triggers 48 are substantially cylindrical. However, triggers may take any shape so long as the overall shape allows for a consistent position measurement with respect to the proximity switch 41.

Once the pendulum assembly 42 is constructed and arranged on the hub 44 of the housing 32, a faceplate 36 is attached to the housing 32. As illustrated in FIGS. 12 and 13, the faceplate 36 can be a translucent material that allows an operator to inspect the pendulum assembly 42 without removing the faceplate 36. Some examples of the translucent material are glass, acrylic glass, or translucent plastic. In other example embodiments, the faceplate 36 material is not translucent, and may be made from a variety of metals, composites, or non-translucent plastics.

Just as the material of the faceplate 36 may vary from one embodiment to the next, so can the size and shape of the faceplate 36. As illustrated in FIG. 12, the shape of the faceplate 36 is substantially the same size and shape of the housing 32. In other example embodiments, the faceplate 36 may be various sizes and shapes, some of them which differ from the size and shape of the housing 32. For example, a housing may have a square shape that is designed to allow for a circular faceplate to be attached.

Accordingly, the faceplate 36 may be attached to the housing 32 in a variety of ways. In one example embodiment, as illustrated in FIG. 12, a faceplate retainer 37 is used in conjunction with faceplate fasteners 38 to attach the faceplate 36 to the housing 32. In this example embodiment, the faceplate 36 is secured between the housing 32 and the faceplate retainer 37 by faceplate fasteners 38 that extend through the faceplate retainer 37 and the faceplate 36 and engage the housing 32. In other embodiments, a faceplate retainer 37 does not have to be utilized. For example, faceplate fasteners 38 may extend directly through the faceplate 36 and engage the housing 32, thus eliminating the need for a faceplate retainer. However, if the faceplate 36 is made out of a brittle material, a faceplate retainer may reduce the risk of stress fractures forming on the faceplate 36 itself.

Once the housing 32 and faceplate 36 are attached together, an enclosure 40 is formed between the housing 32 and faceplate 36 that allows the pendulum assembly 42 to freely rotate. As mentioned, the drain/fill ports 35 may be used to introduce a liquid into the enclosure 40. In one embodiment, for example, the enclosure 40 is partially or entirely filled with a liquid, such as glycerine. Other liquids may be used, however, so long as the viscosity of the liquid remains relatively consistent within the operating temperature environment of the drill rod handler 100. Some other example liquids include natural or synthetic oil based liquids.

To maintain the liquid within the enclosure 40, a seal 39 is arranged between the housing 32 and the faceplate 36. In one example embodiment, the seal 39 is an o-ring. However, in other example embodiments, the seal 39 may have various configurations and be made from a variety of materials such as PTFE or various metals.

As indicated, the level sensor 30 includes a proximity switch 41 that extends through a port in the faceplate 36, as illustrated in FIG. 12. The proximity switch 41 arrangement may vary from one embodiment to the next. For example, the radial location of the proximity switch 41 on the level sensor 30 may vary. FIG. 12 shows one embodiment where the proximity switch 41 is initially arranged ninety degrees from level with respect to gravity. In other embodiments, the proximity switch may be arranged to detect any position point within three hundred and sixty degrees of rotation.

In addition to the radial location, another way in which the location of the proximity switch 41 may vary is the extent to which the proximity switch 41 extends into the enclosure 40. For example, the level sensor 30 may extend into the enclosure 40 to the extent that the triggers 48 contact the proximity switch 41 during the operation of the level sensor 30. In this embodiment, the control center may not only indicate that the elongate member support 13 is in a horizontal position, but it may also stop the rotation of the elongate member support 13, thus acting as a stop once the elongate member support 13 reaches a certain defined position. In another embodiment, the proximity switch 41 may extend slightly less into the enclosure, thus allowing the triggers 48 to pass underneath the proximity switch 41. In this embodiment, the proximity switch 41 is configured to detect the trigger 48 based on a certain distance between the trigger 48 and the proximity switch 41. When the triggers 48 are designed to pass under the proximity switch 41, the elongate member support 13 may be allowed to continue rotating past a defined position, and the proximity switch 41 signals when the elongate member support 13 has rotated past the defined position.

Just as with location of the proximity switch 41, the number of proximity switches 41 is another way in which the proximity switch 41 arrangement may vary. In one example embodiment, as shown in FIG. 12, one proximity switch 41 is used to detect one specific position with respect to level. In other example embodiments, any number of proximity switches 41 may be used to detect various different positions with respect to level. For example, two proximity switches 41 may be used, thus permitting the level sensor 30 to detect when the elongate member support 13 is in a horizontal position and when the elongate member support 13 is in the vertical position, with respect to gravity.

In addition to various proximity switch 41 arrangements, there are various types of proximity switches 41. In one example embodiment, the proximity switch 41 is an inductive type proximity switch. Other example proximity switches include capacitive switches, magnetic switches, laser switches or photo cell switches.

2. The Operation of the Level Sensor

In operation of one example embodiment, the level sensor 30 may be attached to the second powered drive 27, as illustrated in FIG. 9, such that the level sensor 30 rotates about the second axis Y at substantially the same rate as the elongate member support 13. As the level sensor 30 rotates, the pendulum body 43 freely rotates about the hub 44 and maintains a generally constant position with respect to gravity. When the elongate member 13 is in a substantially horizontal position, as shown in FIGS. 1-3, the trigger 48 attached to the pendulum body 43 contacts the proximity switch 41. Upon contact with the trigger 48, the proximity switch 41 sends a signal, or otherwise indicates to the control center (not shown) that the elongate member support 13 is in a substantially horizontal position.

When elongate member support 13 is rotated away from the substantially horizontal position, then the level sensor 30 also rotates. As the level sensor 30 rotates, the pendulum body 43 maintains a constant position with respect to gravity, and the trigger 48 comes out of contact with the proximity switch 41. The proximity switch 41 subsequently indicates to the control center that the elongate member support 13 is no longer in a substantially horizontal position.

Figures 15A, 15B, 15C:
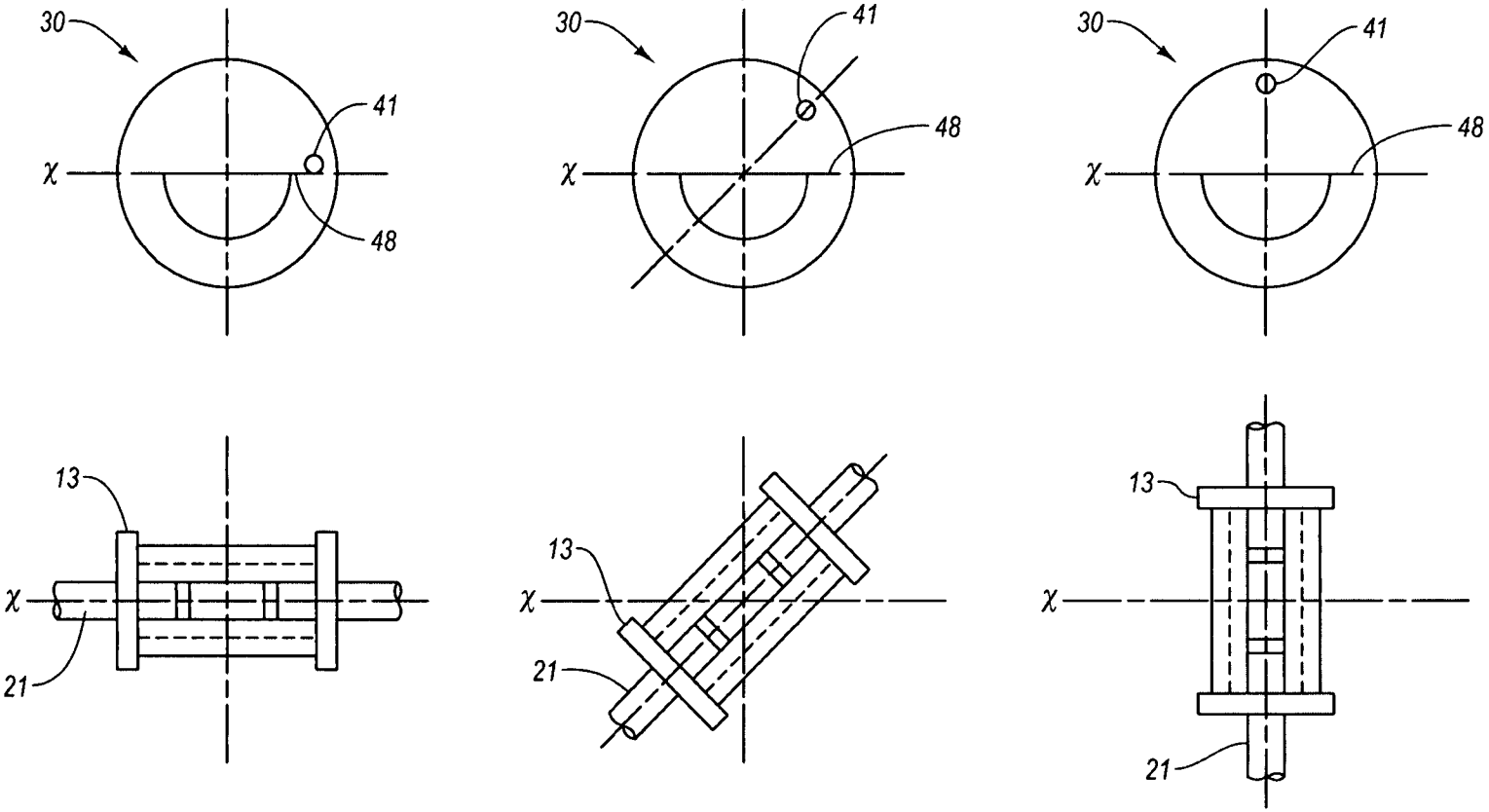
FIG. 15A through 15C illustrate an example embodiment of the level sensor position with respect to the elongate member support position.

FIGS. 15A-15C illustrate the relative position of the proximity switch 41 with respect to the elongate member support 13 orientation. For example, FIG. 15A illustrates that the proximity switch 41 is in contact with the trigger 48 when the elongate member support 13 and the drill rod 21 is in the substantially horizontal position. At this position, the elongate member support 13 is unlocked and may engage or disengage a drill rod 21. As the elongate member support 13 and the drill rod 21 rotate away from the substantially horizontal position, the proximity switch 41 rotates away from the trigger 48 as shown in FIG. 15B. As soon as the trigger 48 is rotated away from the proximity switch, the elongate member support 13 is locked, thus not allowing the elongate member support 13 to disengage the drill rod 21. FIG. 15C illustrates the position of the proximity switch 41 with respect to the trigger 48 when the elongate member support 13 and the drill rod are positioned in a substantially vertical position. Thus, FIGS. 15A-15C illustrate one example of how the level sensor 30 detects the position of the elongate member support 13 with respect to gravity.

In one example embodiment, while the level sensor 30 is rotating, the liquid, such as glycerine, ensures the proper rotation of the pendulum assembly 42 by providing a damping force to the motion of the pendulum assembly 42. This damping force prevents pendulum assembly 42 over-swing as the level sensor 30 rotates, and thus provides a more consistent and reliable position measurement. The liquid may also assist to maintain the components of the level sensor 30 by keeping the pendulum assembly 42 and proximity switch 41 clean and free from external contamination. As a result, the liquid can help prevent faulty trigger detection caused by external contamination. Moreover, the liquid may be used to calibrate the level sensor with respect to gravity because the liquid provides a true reference to gravity no matter the orientation of various other components or machinery.

Rotation Sensor

Just as there are various embodiments of the level sensor 30, there are a variety of embodiments of the rotation sensor 50. For example, the rotation sensor 50 may have a variety of structural and operational embodiments.

1. The Rotation Sensor Structure

Figure 17:
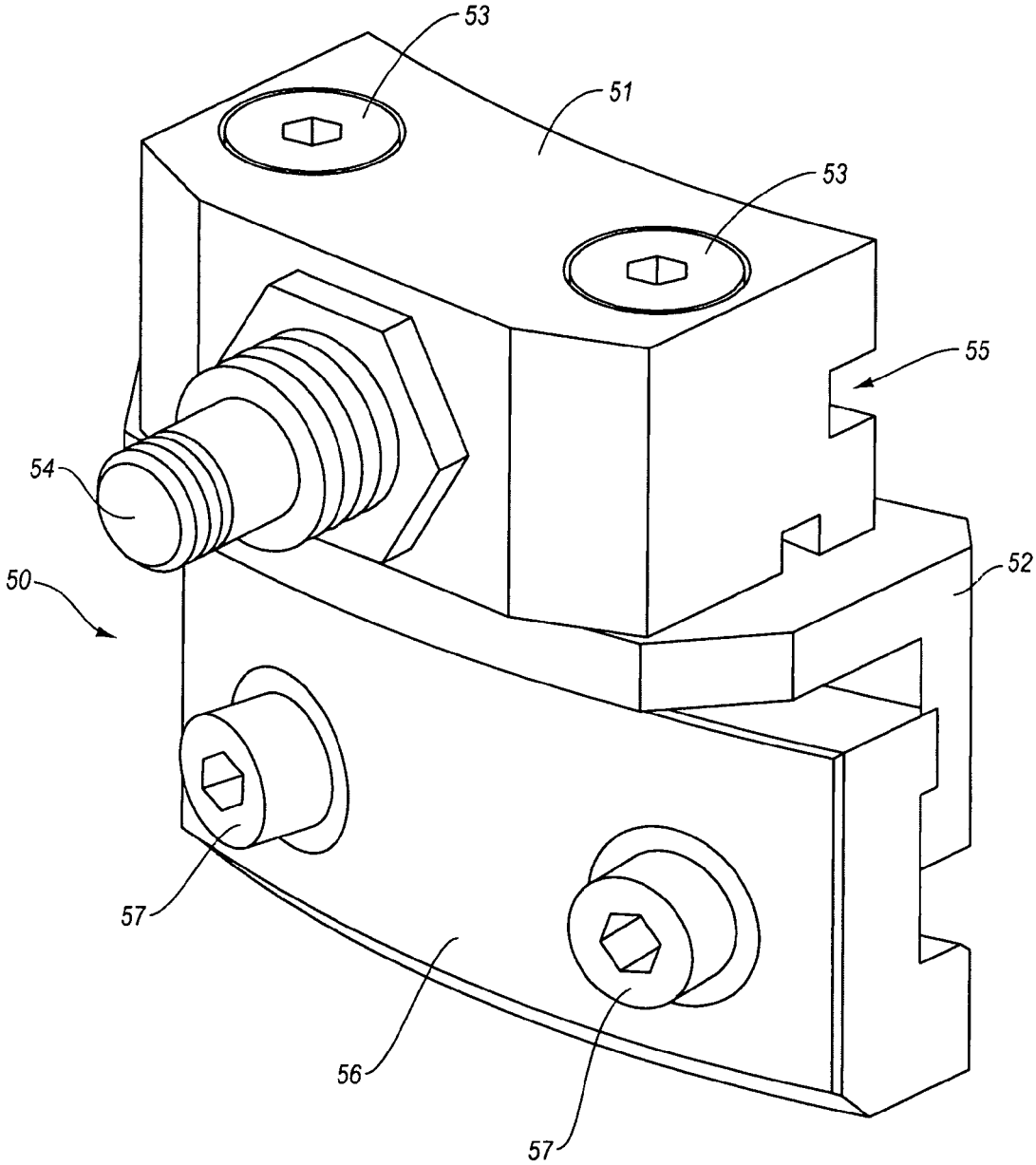
FIG. 17 is an isometric view of an example embodiment of the rotation
Figure 18:
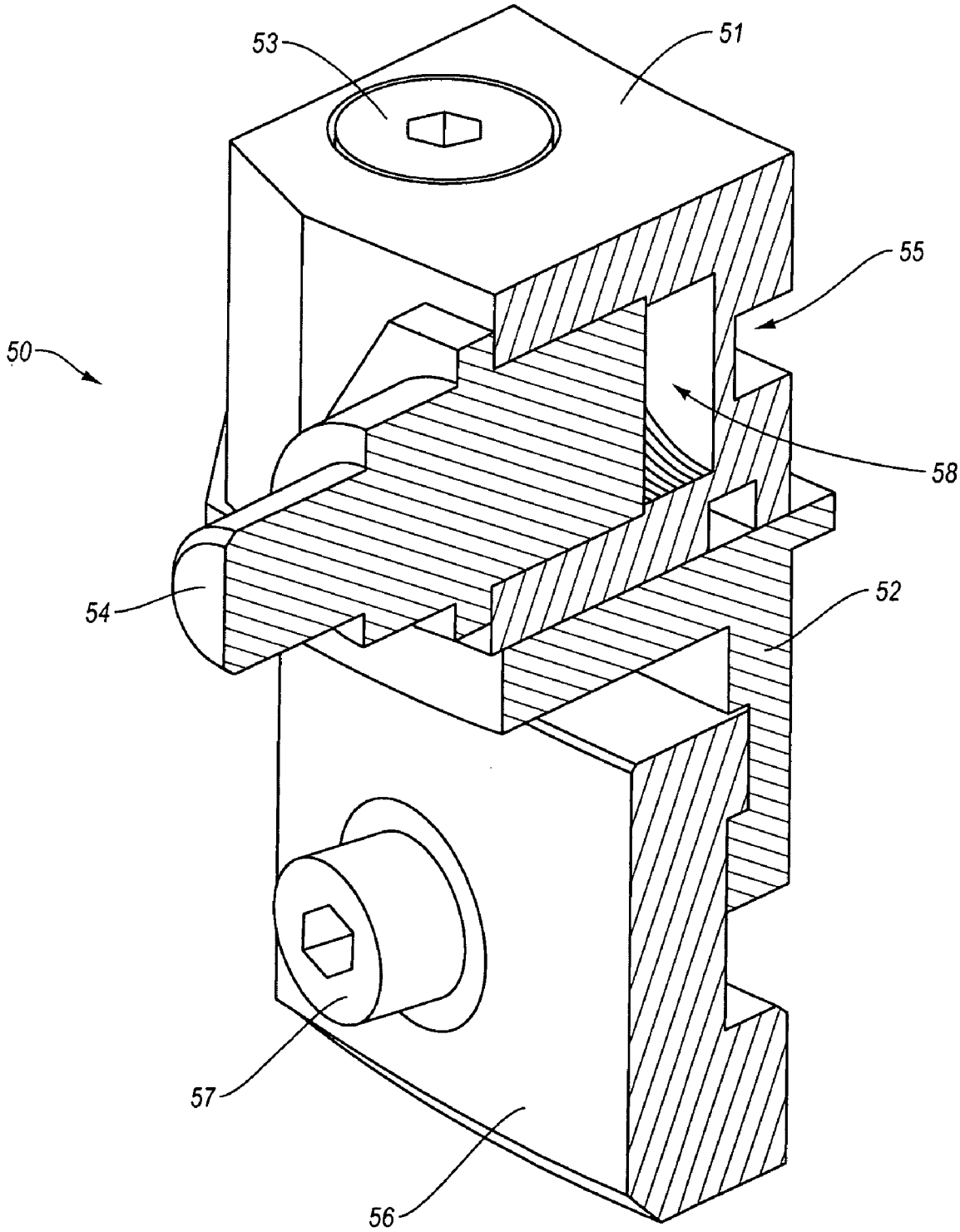
FIG. 18 is an isometric cutaway view of an example embodiment of the rotation sensor.

As shown in FIGS. 17 and 18, an example embodiment of a rotation sensor 50 includes a block 51 which is attached to a block mount 52 with block fasteners 53. A proximity switch 54 is placed within a pocket 58 located in the block 51. The block 51 contains a trigger groove 55 to facilitate the movement of a trigger(s) 60 through the block 51. The block mount 52 couples to a bracket 56, and the bracket 56 is secured to the drill rod handler by bracket fasteners 57.

Figure 16:
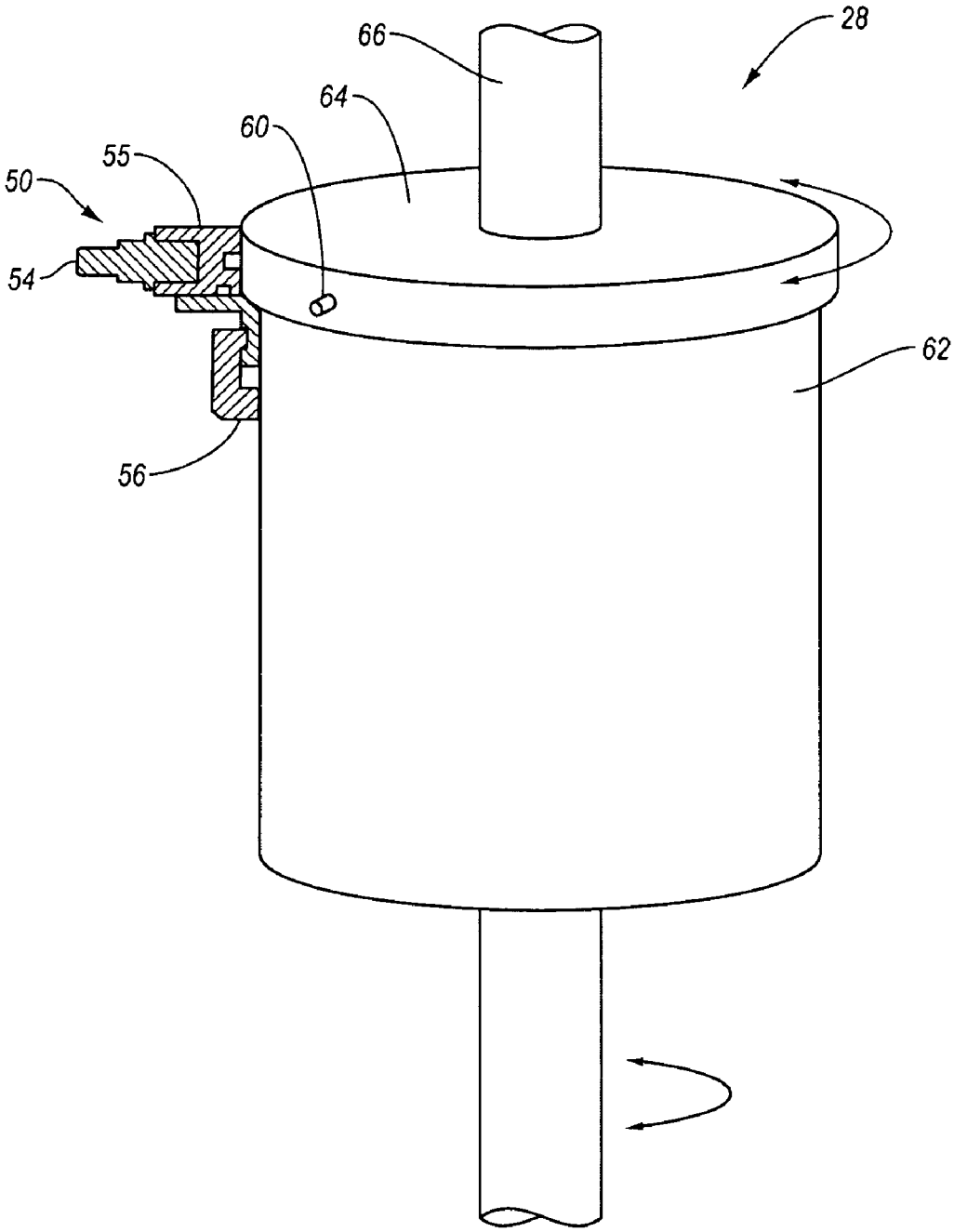
FIG. 16 is an isometric view of an example rotation sensor mounted to a powered drive located on a drill rod handler.

Briefly, in operation, and as illustrated in FIG. 16, the rotation sensor 50 is attached to a fixed component of the drill rod handler 100 such that the rotation sensor 50 remains fixed in place. For example, the rotation sensor may be attached to the fixed portion 62 of the third powered drive 28. The fixed portion 62 of the third powered drive may be a motor or actuator shell that at least partially covers the inner workings of the powered drive. The proximity switch 54 located on the rotation sensor is positioned in close proximity to a rotating portion of the third powered drive 28. The rotating portion of the third powered drive may be the rotating shaft 66 or a rotating disc 64 that rotates at the same rate as the third powered drive. The trigger 60 is attached to the rotating portion 64 of the third powered drive 28 so that as the third powered drive 28 rotates, the trigger 60 can enter the trigger groove 55. For example, the trigger may be positioned on the side the rotating portion 64, as illustrated in FIG. 16. As the trigger 60 passes through the trigger groove 55, the trigger 60 is able to come within a detectable distance to the proximity switch 54. Upon detecting the trigger 60, the proximity switch 54 indicates to the control center (not shown) that a specified rotational position is achieved.

The various components of the rotation sensor 50 may vary from one embodiment to the next. The block 51, for example, may be made from a variety of materials. In one example embodiment, the block 51 is made from nylon, which enables the proximity switch 54 to detect the trigger 60 through the block 51 material. Other example materials include nylon composite materials, plastics, or a combination of composite and plastic material. The block 51 may be made from a variety of other materials so long that the proximity switch 54 can detect the trigger 60 through the block 51 material.

Just as the material of the block 51 may vary from one embodiment to the next, so can the shape of the block 51. In one example embodiment, illustrated in FIGS. 17 and 18, the block 51 has a rectangular base with an upper portion that has a trapezoidal cross section. However, the shape of the block 51 may be any shape so long as the block 51 can accommodate the proximity switch 54.

In addition to the general shape, the block 51 also contains various design features that may vary. As illustrated in FIGS. 17 and 18, the block 51 includes a trigger groove 55 that is configured to allow a trigger 60 to pass through the block 51. In one embodiment, the trigger groove 55 is configured with minimal clearance with respect to the trigger 60 such that dirt, grease, and other contaminants are scrapped away, or otherwise removed from the trigger 60 prior to entering the trigger groove 55.

Another design feature of the block 51 that may vary is the pocket 58. In one example embodiment, illustrated in FIG. 18, the pocket 58 is a blind threaded hole. The blind threaded hole design securely attaches the proximity switch 54 to the block 51 and at the same time protects the proximity switch 54 from contamination due to the fact that the proximity switch 54 is sealed from the outside environment. In other example embodiments, the pocket 58 may take other various forms so long as the pocket 58 securely holds the proximity switch 54 in the desired location.

The pocket 58 may be designed to accommodate various types of proximity switches 54. Some examples of proximity switches 54 include inductive, capacitive, or magnetic type proximity switches 54. Accordingly, the trigger 60 material may be any material that has the inductive, capacitive, or magnetic properties as required by the type of proximity switches 54 used.

As mentioned above, in one embodiment of the rotation sensor 50, the block 51 attaches to the block mount 52 by way of block fasteners 53, as shown in FIG. 17. FIG. 17 shows the block fasteners 53 as threaded fasteners. However, in other example embodiments, the block fasteners may be more permanent, such as rivets. Moreover, the block 51 may be attached to the block mount 52 by way of a chemical bond, such as with glue that is applied between the block and the block mount.

The block mount 52 may take various shapes depending on the location of the rotation sensor 50. In one example embodiment, shown in FIGS. 17 and 18, the block mount 52 is an L-shaped mount with a lip designed to couple with the bracket 56. However, in other example embodiments, the block mount may be configured in different shapes depending on various design considerations such as the mounting location of the rotation sensor 50.

In an example embodiment, the block mount 52 is designed to couple with the bracket 56, as shown in FIGS. 17 and 18. In this example embodiment, the bracket 56 contains ports through which bracket fasteners 57 extend. The bracket fasteners secure the bracket 56, and subsequently the block mount 52 and block 51, to the third powered drive 28, for example. The bracket fasteners 57 may be threaded fasteners that may be tightened or loosened to allow adjustment of the block 51 position. In particular, if the bracket fasteners 57 are loosened, then the block mount 52 is permitted to slide within, or along the bracket 56, thus adjusting the location of the proximity switch 54.

Instead of a bracket, other example rotation sensor embodiments may attach to the drill rod handler 100 in various ways. For example, the block mount may directly be attached to the drill rod handler using various fasteners or chemical bonds, such as welding.

2. Operation of the Rotation Sensor

In operation, for example, the rotation sensor 50 can be attached to a fixed component of the drill rod handler by way of the bracket 56 such as, for example, the fixed portion 62 of the third powered drive 28, as shown in FIG. 16. The rotation sensor 50 is positioned in close proximity to the rotating portion 64 of the third powered drive 28. The trigger 60 is attached to the rotating portion 64 of the third powered drive 28 such that as the third powered drive 28 rotates, the trigger 60 can enter the trigger groove 55 located on the block 51. As the trigger 60 passes through the trigger groove 55, the trigger is able to come within a detectable distance to the proximity switch 54. Upon detecting the trigger 60, the proximity switch 54 indicates to the control center (not shown) that a specified rotation position is achieved.

Figure 19C:
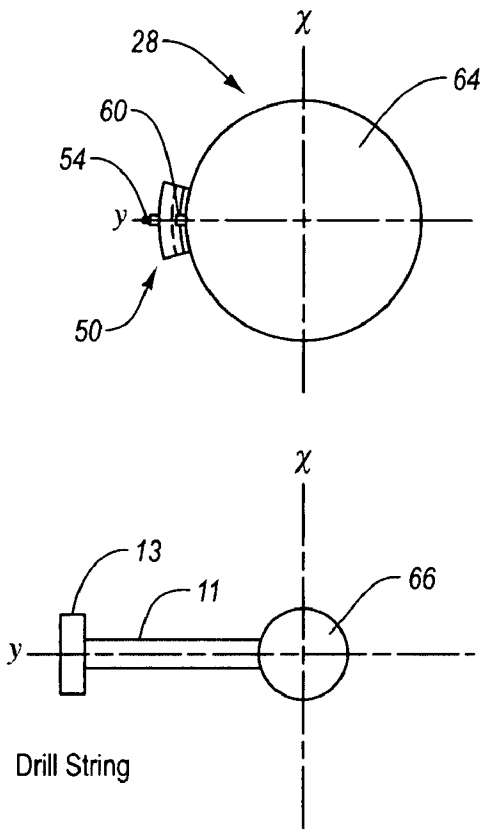
FIG. 19A through 19C illustrate an example embodiment of the rotation sensor position with respect to the elongate member support position.
Figure 19B:
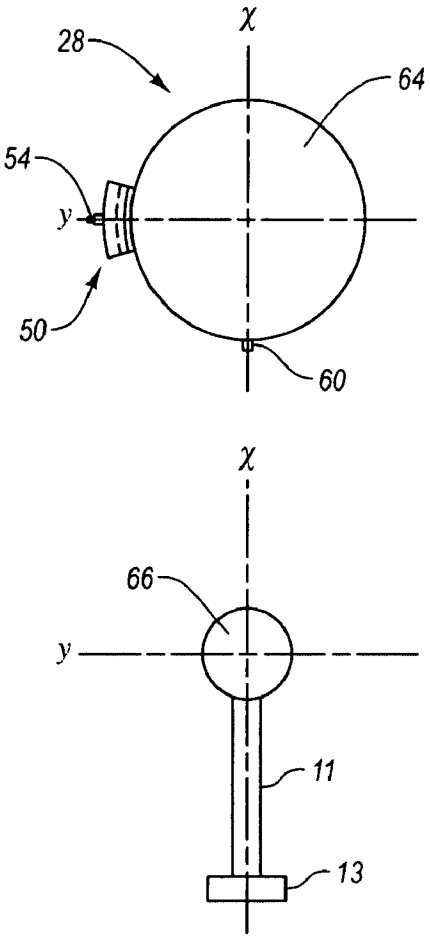
Figure 19A:
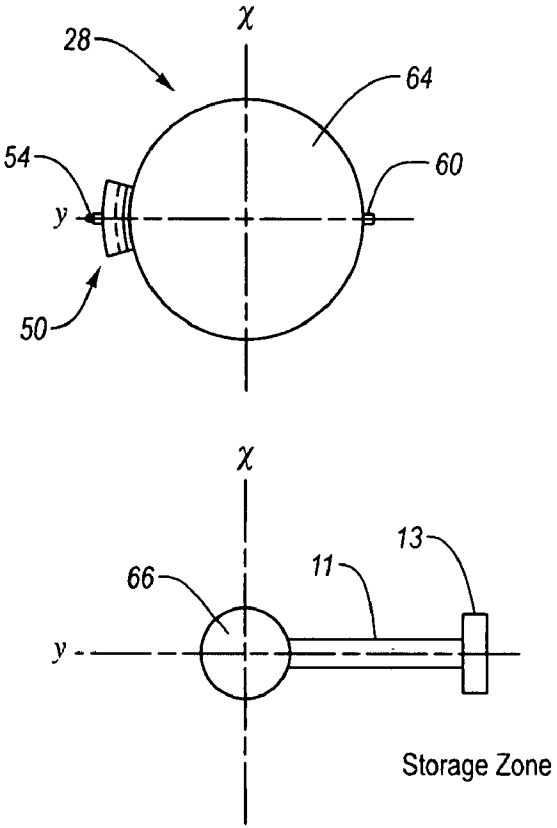

In particular, FIGS. 19A-19C illustrate a top view of the trigger 60 position relative to the orientation of the elongate member support 13 about the third axis Z. For example, FIG. 19A illustrates the elongate member support 13 supported by the radial arm 11 in an example position that represents when the elongate member support 13 is in a storage zone position about the third axis Z. As shown, in this position the trigger 60 is located away from the rotation sensor 50, and thus the proximity switch 54 is not triggered.

As the elongate member support 13 is rotated about the third axis Z, the trigger 60 rotates at the same rate as the elongate member support 13, as shown in FIG. 19B. Upon further rotation, the elongate member support 13 may reach a drill string position represented by FIG. 19C. In this position, the trigger 60 has entered into the block 51 through the trigger grooves 55 such that the trigger 60 is within a close proximity to the proximity switch 54. At this position, for example, the proximity switch 54 detects the trigger 60 and indicates to a control center that the drill string position has been achieved. The control center may then, for example, allow the clamps 15 to disengage the drill rod 21 to allow the drill rod 21 to couple to the drill string (or the control center may allow the clamps 15 to engage the drill rod 21 if decoupling the drill rod 21 from the drill string).

In other example embodiments, multiple triggers 60 may be placed on the rotating portion 64 of the third powered drive 28 such that the proximity switch 54 may indicate various positions of the elongate member support 13 with respect to the third axis Z.

The present invention is not to be limited in scope by the specific embodiment described herein. The embodiments are intended for the purpose of explanation only. Functionally equivalent features and methods are clearly within the scope of the invention as described herein.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A drill rod handler comprising:

a movable clamp configured to grasp a drill rod in a first, storage position with a first orientation;

a first drive for rotating said moveable clamp about an first axis that is parallel and offset from the drill rod when grasped in said moveable clamp;

a second drive for rotating said moveable clamp about a horizontal axis to move the drill rod when grasped in said moveable clamp from the first orientation toward a vertical orientation and into a second orientation;

a third drive for rotating said moveable clamp about a second axis to move the drill rod into a second, drilling position while maintaining the drill rod in the second orientation, the second axis being parallel and offset from the drill rod when in the second orientation;

one or more position sensors configured to detect when the grasped drill rod is in the first position with the first orientation and the second position with the second orientation, wherein the one or more position sensors comprise a housing, a pendulum rotatably connected to the housing that maintains a constant position with respect to gravity, a trigger extending from the pendulum, and a proximity switch that moves with respect to the trigger and is configured to detect the trigger at a specified position;

a control center communicably connected to said one or more position sensors, wherein said control center permits or restricts said moveable clamp from grasping or releasing the drill rod based on the position of said moveable clamp;

a faceplate coupled to the housing, the housing and the faceplate forming an enclosure, the pendulum being free to rotate within the enclosure; and a liquid disposed within the enclosure.

2. The drill rod handler as recited in claim 1, wherein the faceplate is a translucent material, and the liquid is glycerine.

3. A drill rod handler comprising:

a movable clamp configured to grasp a drill rod in a first, storage position with a first orientation;

a first drive for rotating said moveable clamp about an first axis that is parallel and offset from the drill rod when grasped in said moveable clamp;

a second drive for rotating said moveable clamp about a horizontal axis to move the drill rod when grasped in said moveable clamp from the first orientation toward a vertical orientation and into a second orientation;

a third drive for rotating said moveable clamp about a second axis to move the drill rod into a second, drilling position while maintaining the drill rod in the second orientation, the second axis being parallel and offset from the drill rod when in the second orientation;

one or more position sensors configured to detect when the grasped drill rod is in the first position with the first orientation and the second position with the second orientation, wherein the one or more position sensors comprise a housing, a pendulum rotatably connected to the housing that maintains a constant position with respect to gravity, a trigger extending from the pendulum, and a proximity switch that moves with respect to the trigger and is configured to detect the trigger at a specified position;

a control center communicably connected to said one or more position sensors, wherein said control center permits or restricts said moveable clamp from grasping or releasing the drill rod based on the position of said moveable clamp;

a plurality of fastener ports extending through the housing; and a corresponding plurality of fasteners, wherein the fastener ports are configured to have a cross-sectional dimension larger than a cross-sectional dimension of the fasteners to allow the housing to have adjustable mounting positions.

4. The drill rod handler as recited in claim 3, wherein the moveable engaging means is a clamping device.

5. The drill rod handler as recited in claim 4, wherein the control center restricts the clamping device from disengaging the drill rod when the clamping device is not in the first position with the first orientation or the second position with the second orientation.

6. The drill rod handler as recited in claim 3, wherein the one or more position sensors include:

a level sensor that detects one or more positions of the moveable engaging means with respect to gravity; and a rotation sensor that detects one or more radial positions of the moveable engaging means with respect to a defined axis.

7. The drill rod handler as recited in claim 6, further comprising:

a storage zone within reach of the moveable engaging means and configured to hold a plurality of drill rods;

wherein the first position is located at the storage zone and the first orientation is perpendicular to gravity; and a connection zone within reach of the moveable engaging means and configured to facilitate a coupling or decoupling of the drill rod to a drill string;

wherein the second position is located at the connection zone and the second orientation is substantially parallel to gravity.

8. The drill rod handler as recited in claim 7, wherein the control center restricts the moveable engaging means from disengaging the drill rod when the movable engaging means is not located at the storage zone or the connection zone.

9. The drill rod handler as recited in claim 3, wherein the specified position includes when the moveable engaging means of the drill rod handler is in a horizontal position with respect to gravity.

10. The drill rod handler as recited in claim 3, further comprising:

a plurality of additional triggers attached to the pendulum, wherein the additional triggers are configured to detect a corresponding plurality of positions.

11. A drill rod handler, comprising:

a moveable clamp configured to engage a drill rod; and a position sensor system, the position sensor system comprising:

a level sensor configured to detect a level position of the moveable clamp with respect to gravity, the level sensor comprising:

a housing, a pendulum rotatably connected to the housing that maintains a constant position with respect to gravity, a trigger extending from the pendulum, a proximity switch that moves with respect to the trigger and is configured to detect the trigger at a specified position, a faceplate coupled to the housing, the housing and the faceplate forming an enclosure, the pendulum being free to rotate within the enclosure, and a liquid disposed within the enclosure;

a rotation sensor configured to detect a rotational position of the moveable clamp with respect to a defined axis that runs parallel to gravity; and a control center communicably connected to the level sensor and the rotation sensor.

12. The drill rod handler as recited in claim 11, wherein the level sensor is further configured to detect when the moveable clamp is in a storage zone position, which permits the moveable clamp to retrieve or return the drill rod from or to a storage container.

13. The drill rod handler as recited in claim 12, wherein the rotation sensor is further configured to detect when the moveable clamp is in a connection position, which permits the moveable clamp to disengage or engage the drill rod to couple or decouple the drill rod to or from a drill string.

14. The drill rod handler as recited in claim 13, wherein when the level sensor and the rotation sensor are not detecting the storage zone position or the connection position, then the control center locks the moveable clamp such that the moveable clamp cannot open or close.

15. The drill rod handler as recited in claim 14, wherein when the level sensor detects the storage zone position, or when the rotation sensor detects the connection position, then the control center unlocks the moveable clamp such that the moveable clamp may open or close.

16. The drill rod handler as recited in claim 15, wherein the control center is programmed to automatically engage the drill rod at the storage zone position, transport the drill rod to the connection position, and disengage the drill rod at the connection position.

17. The drill rod handler as recited in claim 16, wherein the control center is programmed to automatically engage the drill rod at the connection position, transport the drill rod to the storage zone position, and disengage the drill rod at the storage zone position.

18. The drill rod handler as recited in claim 11, wherein the control center is communicably connected to a plurality of additional position sensors configured to detect a corresponding plurality of moveable clamp positions.

19. A drill rod handler, comprising:

a movable clamp configured to engage a drill rod and move the drill rod between a first position with a first orientation and a second position with a second orientation;

one or more position sensors configured to detect the first position with the first orientation and the second position with the second orientation; and a control center communicably connected to the one or more position sensors, wherein the control center permits or restricts the moveable clamp from engaging or disengaging the drill rod based on the position of the moveable clamp;

wherein the one or more position sensors comprise:

a housing;

a pendulum rotatably connected to the housing that maintains a constant position with respect to gravity;

a trigger extending from the pendulum;

a proximity switch that moves with respect to the trigger and is configured to detect the trigger at a specified position;

a plurality of fastener ports extending through the housing; and a corresponding plurality of fasteners, wherein the fastener ports are configured to have a cross-sectional dimension larger than a cross-sectional dimension of the fasteners to allow the housing to have adjustable mounting positions.

* * * * *